US012439992B2

(12) United States Patent
Van Nortwick et al.

(10) Patent No.: US 12,439,992 B2
(45) Date of Patent: Oct. 14, 2025

(54) SURGICAL HELMET ASSEMBLY HAVING AN ADJUSTMENT MECHANISM

(71) Applicant: Stryker Corporation, Kalamazoo, MI (US)

(72) Inventors: Matthew Van Nortwick, Ann Arbor, MI (US); Beau M. Kidman, Kalamazoo, MI (US)

(73) Assignee: Stryker Corporation, Portage, MI (US)

( * ) Notice: Subject to any disclaimer, the term of this patent is extended or adjusted under 35 U.S.C. 154(b) by 161 days.

(21) Appl. No.: 18/240,863

(22) Filed: Aug. 31, 2023

(65) Prior Publication Data

US 2023/0404204 A1 Dec. 21, 2023

Related U.S. Application Data

(63) Continuation of application No. 17/286,351, filed as application No. PCT/US2019/050222 on Sep. 9, 2019, now Pat. No. 11,793,261.

(Continued)

(51) Int. Cl.

| | |
|---|---|
| ***A42B 3/28*** | (2006.01) |
| ***A42B 3/14*** | (2006.01) |
| *A42B 7/00* | (2006.01) |

(52) U.S. Cl.

CPC ..... *A42B 3/286* (2013.01); *A42B 3/145* (2013.01); *A42B 3/283* (2013.01); *A42B 7/00* (2013.01)

(58) Field of Classification Search

CPC ..... A42B 3/085; A42B 3/14; A42B 3/142; A42B 3/145

See application file for complete search history.

(56) References Cited

U.S. PATENT DOCUMENTS 5,301,372 A 4/1994 Matoba
5,630,412 A 5/1997 Dubruille et al.

(Continued)

FOREIGN PATENT DOCUMENTS

AU 2012254955 A1 12/2012
CN 1735439 A 2/2006

(Continued)

OTHER PUBLICATIONS

English language abstract for JP 2006-505373 A extracted from espacenet.com database on Sep. 4, 2023, 2 pages.

(Continued)

*Primary Examiner* — Katherine M Moran

(74) *Attorney, Agent, or Firm* — Howard & Howard Attorneys PLLC

(57) ABSTRACT

A surgical helmet assembly to be worn by a user during surgical operations. The surgical helmet assembly includes a frame assembly having a helmet shell to be worn over the user's head. A fan is coupled to the helmet shell to circulate air around the helmet shell. A headband assembly is coupled to the helmet shell to secure the surgical helmet assembly to the head of the user. The surgical helmet assembly further includes an adjustment assembly to adjust a sagittal fit of the helmet shell and the headband assembly to the head of the user while keeping a center of mass of the frame assembly in close proximity to the head of the user. The surgical helmet assembly may further include another adjustment assembly concentric to the first adjustment assembly to adjust a circumferential fit of the headband assembly to the head of the user.

20 Claims, 20 Drawing Sheets

Related U.S. Application Data

(60) Provisional application No. 62/749,837, filed on Oct. 24, 2018.

(56) References Cited

U.S. PATENT DOCUMENTS

| | | | | |
|---|---|---|---|---|
| 5,711,033 | A | 1/1998 | Green et al. | |
| 6,170,084 | B1 | 1/2001 | Gordon et al. | |
| 6,481,019 | B2 | 11/2002 | Diaz et al. | |
| 6,622,311 | B2 | 9/2003 | Diaz et al. | |
| 6,792,944 | B1 | 9/2004 | Green et al. | |
| 6,865,752 | B2 | 3/2005 | Udelhofen et al. | |
| 6,918,141 | B2 | 7/2005 | Green et al. | |
| 6,928,662 | B2 | 8/2005 | Fournier | |
| 6,954,968 | B1 | 10/2005 | Sitbon | |
| 6,973,677 | B2 | 12/2005 | Diaz et al. | |
| 7,093,302 | B1 | 8/2006 | Burns | |
| 7,200,873 | B2 | 4/2007 | Klotz et al. | |
| 7,225,471 | B2 | 6/2007 | Sutter et al. | |
| 7,735,156 | B2 | 6/2010 | VanDerWoude et al. | |
| 7,752,682 | B2 | 7/2010 | VanDerWoude et al. | |
| 7,937,775 | B2 | 5/2011 | Manzella, Jr. et al. | |
| 7,950,073 | B2 | 5/2011 | Ferrara | |
| 8,196,224 | B2 | 6/2012 | Manzella, Jr. et al. | |
| 8,225,421 | B1 | 7/2012 | Froissard | |
| 8,234,722 | B2 | 8/2012 | VanDerWoude et al. | |
| 8,261,375 | B1 | 9/2012 | Reaux | |
| 8,282,234 | B2 | 10/2012 | VanDerWoude et al. | |
| 8,302,599 | B2 | 11/2012 | Green | |
| 8,348,448 | B2 | 1/2013 | Orozco et al. | |
| 8,407,818 | B2 | 4/2013 | VanDerWoude et al. | |
| 8,453,262 | B2 | 6/2013 | Green | |
| 8,510,870 | B2 | 8/2013 | Rogers et al. | |
| 8,621,375 | B2 | 12/2013 | Berger et al. | |
| 8,621,664 | B2 | 1/2014 | Peebles | |
| 8,713,718 | B2 | 5/2014 | Moelker | |
| 8,745,763 | B2 | 6/2014 | Cho | |
| 8,819,869 | B2 | 9/2014 | VanDerWoude et al. | |
| 8,899,774 | B2 | 12/2014 | Strong et al. | |
| 8,955,168 | B2 | 2/2015 | Manzella, Jr. et al. | |
| 9,066,551 | B2 | 6/2015 | Van Waes | |
| 9,173,437 | B2 | 11/2015 | VanDerWoude et al. | |
| 9,179,729 | B2 | 11/2015 | Cotterman et al. | |
| 9,833,032 | B2 | 12/2017 | Jacobsen | |
| 9,907,348 | B2 | 3/2018 | Huh | |
| 9,980,529 | B1 | 5/2018 | Hajianpour | |
| 10,194,710 | B2 | 2/2019 | Huh | |
| 10,420,386 | B1 | 9/2019 | Jefferis et al. | |
| 10,441,019 | B2 | 10/2019 | Huh | |
| 10,750,800 | B2 | 8/2020 | Jefferis et al. | |
| 10,830,428 | B2 | 11/2020 | Africa et al. | |
| 11,576,454 | B1 * | 2/2023 | Wu | A42B 3/20 |
| 11,666,725 | B2 | 6/2023 | Berthon-Jones et al. | |
| 11,793,261 | B2 * | 10/2023 | Van Nortwick | A42B 3/14 |
| 2001/0052144 | A1 | 12/2001 | Paris et al. | |
| 2005/0010992 | A1 | 1/2005 | Klotz et al. | |
| 2005/0193470 | A1 | 9/2005 | Nalls | |
| 2007/0060011 | A1 | 3/2007 | Daftari et al. | |
| 2007/0250986 | A1 | 11/2007 | Zuber | |
| 2009/0151054 | A1 | 6/2009 | VanDerWoude et al. | |
| 2013/0111648 | A1 | 5/2013 | Huh | |
| 2013/0239302 | A1 | 9/2013 | Ahlgren et al. | |
| 2013/0283508 | A1 | 10/2013 | Durham et al. | |
| 2015/0000007 | A1 | 1/2015 | Gleason et al. | |
| 2015/0082522 | A1 | 3/2015 | Rosati et al. | |
| 2015/0090254 | A1 | 4/2015 | Pavalarajan et al. | |
| 2015/0375019 | A1 | 12/2015 | VanDerWoude et al. | |
| 2016/0174648 | A1 | 6/2016 | Garneau et al. | |
| 2017/0006951 | A1 | 1/2017 | Venturini et al. | |
| 2017/0123451 | A1 | 5/2017 | Baudou et al. | |
| 2017/0196281 | A1 | 7/2017 | Rosati et al. | |
| 2017/0340044 | A1 | 11/2017 | Balderama Arenas et al. | |
| 2018/0035741 | A1 | 2/2018 | VanDerWoude et al. | |
| 2018/0084848 | A1 | 3/2018 | Pavalarajan et al. | |
| 2020/0121017 | A1 | 4/2020 | King et al. | |
| 2020/0390182 | A1 | 12/2020 | Huh et al. | |
| 2021/0251329 | A1 | 8/2021 | Pasala | |
| 2021/0259344 | A1 | 8/2021 | Manni | |
| 2021/0337910 | A1 | 11/2021 | Musow et al. | |
| 2021/0368904 | A1 | 12/2021 | van Nortwick et al. | |
| 2022/0202127 | A1 | 6/2022 | Lu | |

FOREIGN PATENT DOCUMENTS

| | | | |
|---|---|---|---|
| CN | 101873811 | A | 10/2010 |
| CN | 102186369 | A | 9/2011 |
| CN | 102245042 | A | 11/2011 |
| CN | 106998842 | A | 8/2017 |
| EP | 1925222 | A2 | 5/2008 |
| EP | 1806986 | B1 | 7/2009 |
| JP | 2006505373 | A | 2/2006 |
| JP | 2012162809 | A | 8/2012 |
| WO | 0152675 | A2 | 7/2001 |
| WO | 2007011646 | A2 | 1/2007 |
| WO | 2014160149 | A2 | 10/2014 |
| WO | 2017112485 | A1 | 6/2017 |
| WO | 2017184479 | A2 | 10/2017 |
| WO | 2019147923 | A1 | 8/2019 |
| WO | 2020086180 | A1 | 4/2020 |

OTHER PUBLICATIONS

English language abstract and machine-assisted English translation for CN 1735439 A extracted from espacenet.com database on Feb. 23, 2024, 53 pages.

English language abstract for CN 101873811 A extracted from espacenet.com database on Feb. 23, 2024, 2 pages.

English language abstract for CN 102186369 A extracted from espacenet.com database on Feb. 23, 2024, 2 pages.

English language abstract for CN 102245042 A extracted from espacenet.com database on Feb. 23, 2024, 1 page.

English language abstract and machine-assisted English translation for CN 106998842 A extracted from espacenet.com database on Feb. 23, 2024, 12 pages.

English language abstract for EP 1806986 B1 extracted from espacenet.com database on Feb. 23, 2024, 1 page.

English language abstract and machine-assisted English translation for JP 2012-162809 A extracted from espacenet. com database on Feb. 23, 2024, 10 pages.

Bio-Medical Devices INTL, "MaxAir Systems 2270-01 Pre-Filter DLC Hood Instructions for Use", Available on or before Apr. 2017, 3 pages.

International Search Report for Application No. PCT/US2019/015128 dated Jun. 21, 2019, 5 pages.

International Search Report for Application No. PCT/US2019/050222 dated Jan. 27, 2020, 5 pages.

Partial International Search Report for Application No. PCT/US2019/050222 dated Nov. 15, 2019, 2 pages.

THI GMBH, "Vivi Brochure", Oct. 2017, 16 pages.

* cited by examiner

SURGICAL HELMET ASSEMBLY HAVING AN ADJUSTMENT MECHANISM

RELATED APPLICATIONS

This application is a continuation of U.S. patent application Ser. No. 17/286,351, filed Apr. 16, 2021, which is the National Stage of International Patent Application No. PCT/US2019/050222, filed Sep. 9, 2019, which claims priority to and all the benefits of U.S. Provisional Patent Application No. 62/749,837, filed on Oct. 24, 2018, all of which are hereby incorporated herein by reference in their entirety.

BACKGROUND

Personal protection systems are used in surgical procedures to provide a sterile barrier between the surgical personnel and the patient. Specifically, the traditional system includes a helmet that supports a toga or a hood. This system is worn by medical/surgical personnel that want to establish the sterile barrier. The toga or the hood may include a transparent face shield. The helmet includes a ventilation unit that includes a fan. The ventilation unit draws air through the toga/hood so the air is circulated around the wearer. This reduces both the amount of heat that is trapped within the toga/hood and the amount of CO2 that builds up in this space. It is further known to mount a light to the helmet, which may be directed to illuminate the surgical site.

Often, surgical personnel wear helmets for long durations. Helmet fit and form play a large role in maintaining comfort for surgical personnel. To maintain a proper fit, helmets must be able to accommodate varying head sizes for different surgical personnel. A surgical helmet assembly with features designed to overcome at least the aforementioned challenges is desired. These and other configurations, features, and advantages of the present disclosure will be apparent to those skilled in the art. The present disclosure is not to be limited to or by these configurations, features, and advantages

SUMMARY

The present disclosure relates generally to a surgical helmet assembly for mounting to a head of a user during surgical operations. An exemplary configuration provides a surgical helmet assembly including a frame assembly. The frame assembly includes a helmet shell having a first end and a second end. The frame assembly also includes a fan coupled to the helmet shell for circulating air. The frame assembly further includes a headband assembly. The headband assembly has a front support member coupled to the helmet shell near the first end of the helmet shell. The front support member is configured to abut a forehead of the user. The headband assembly also has a rear support member coupled to the helmet shell adjacent the second end of the helmet shell. The rear support member is configured to abut a rear region of the head of the user. The headband assembly further includes a strap having a first end movably coupled to the rear support member and a second end coupled to the front support member. The surgical helmet assembly also includes a first adjustment assembly including a first actuation member that is rotatably coupled to the rear support member. The first actuation member is rotatable about an actuation axis. The first adjustment assembly also includes a tension element having a first end operatively connected to the first actuation member and a second end coupled to the front support member. The tension element is movable relative to the helmet shell in response to rotation of the first actuation member to adjust a sagittal fit of the frame assembly and the headband assembly to the head of the user. The surgical helmet assembly further includes a second adjustment assembly. The second adjustment assembly has a second actuation member rotatably coupled to the rear support member. The second actuation member is rotatable about the actuation axis such that the first actuation member and the second actuation member are concentric. The second actuation member is operatively coupled to the strap adjacent the first end of the strap. The strap is movable relative to the rear support member in response to rotation of the second actuation member to adjust a circumferential fit of the headband assembly to the head of the user.

Another exemplary configuration provides a surgical helmet assembly including a frame assembly. The frame assembly includes a helmet shell having a first end and a second end. The helmet shell also has an interior surface. The frame assembly also includes a fan coupled to the helmet shell for circulating air. The frame assembly further includes a headband assembly forming a continuous loop configured to circumferentially surround the head of the user. The headband assembly has a front support member coupled to the helmet shell near the first end of the helmet shell. The front support member has a base portion configured to abut a forehead of the user. The headband assembly also has a rear support member coupled to the helmet shell adjacent the second end of the helmet shell. The rear support member is configured to abut a rear region of the head of the user. The surgical helmet assembly further includes an adjustment assembly. The adjustment assembly has an actuation member rotatably coupled to one of the helmet shell and the rear support member. The actuation member is rotatable about an actuation axis. The adjustment assembly also has a tension element having a first end operatively connected to the actuation member and a second end coupled to the front support member. The tension element is movable relative to the helmet shell in response to rotation of the actuation member. The front support member is moveable relative to the helmet shell in response to movement of the tension element from rotation of the actuation member. The front support member is movable to a first position defining a first head receiving volume bounded by the continuous loop and the interior surface of the helmet shell. The front support member is also movable relative to the helmet shell to a second position defining a second head receiving volume bounded by the continuous loop and the interior surface of the helmet shell. The first head receiving volume is larger than the second head receiving volume to accommodate a plurality of head sizes while retaining the interior surface of the helmet shell in close proximity to the head of the user when the front support member moves between the first position, the second position, and intermediate positions.

Yet another exemplary configuration provides a surgical helmet assembly including a frame assembly. The frame assembly includes a helmet shell having a first end and a second end. The frame assembly also includes a fan coupled to the helmet shell for circulating air. The frame assembly further includes a headband assembly forming a continuous loop configured to circumferentially surround the head of the user. The headband assembly has a front support member coupled to the helmet shell near the first end of the helmet shell. The front support member is configured to abut a forehead of the user. The headband assembly also has a rear support member coupled to the helmet shell adjacent the second end of the helmet shell. The rear support member is configured to abut a rear region of the head of the user. The headband assembly also has a pair of straps coupled to the rear support member and the front support member. The front support member, the pair of straps, and the rear support member collectively form the continuous loop. At least one strap of the pair of straps is configured to be engaged by an actuation member. The front support member is formed from a first material. The rear support member is formed from a second material. The pair of straps are formed from a third material. The second and third materials are different from the first material.

Another exemplary configuration provides a surgical helmet assembly including a frame assembly. The frame assembly includes a helmet shell having a first end and a second end. The helmet shell also has a duct. The duct defines an inlet opening, a lower face nozzle, and a pressure relief vent. The lower face nozzle disposed adjacent the first end of the helmet shell and the pressure relief vent disposed between the lower face nozzle and the second end of the helmet shell. The frame assembly also includes a ventilation sub-assembly having a fan coupled to the helmet shell. The fan is configured to draw air into the duct through the inlet opening. The fan is further configured to force air drawn into the duct toward the lower face nozzle. The fan is also configured to expel air out of the duct through the lower face nozzle and the pressure relief vent. The surgical helmet assembly further includes a headband assembly having a front support member and a rear support member for abutting the head of the user and coupling the frame assembly to the head of the user. The lower face nozzle of the duct is positioned such that the fan is configured to expel air through the lower face nozzle toward the lower face of the user. The pressure relief vent of the duct is positioned between the lower face nozzle and the fan such that the fan is configured to expel air through the pressure relief vent while air is being forced through the duct to the lower face nozzle to optimize flow characteristics of the air in the duct to increase efficiency of the ventilation sub-assembly.

BRIEF DESCRIPTION OF THE DRAWINGS

Advantages of the present disclosure will be readily appreciated as the same becomes better understood by reference to the following detailed description when considered in connection with the accompanying drawings.

DETAILED DESCRIPTION

Figure 1:
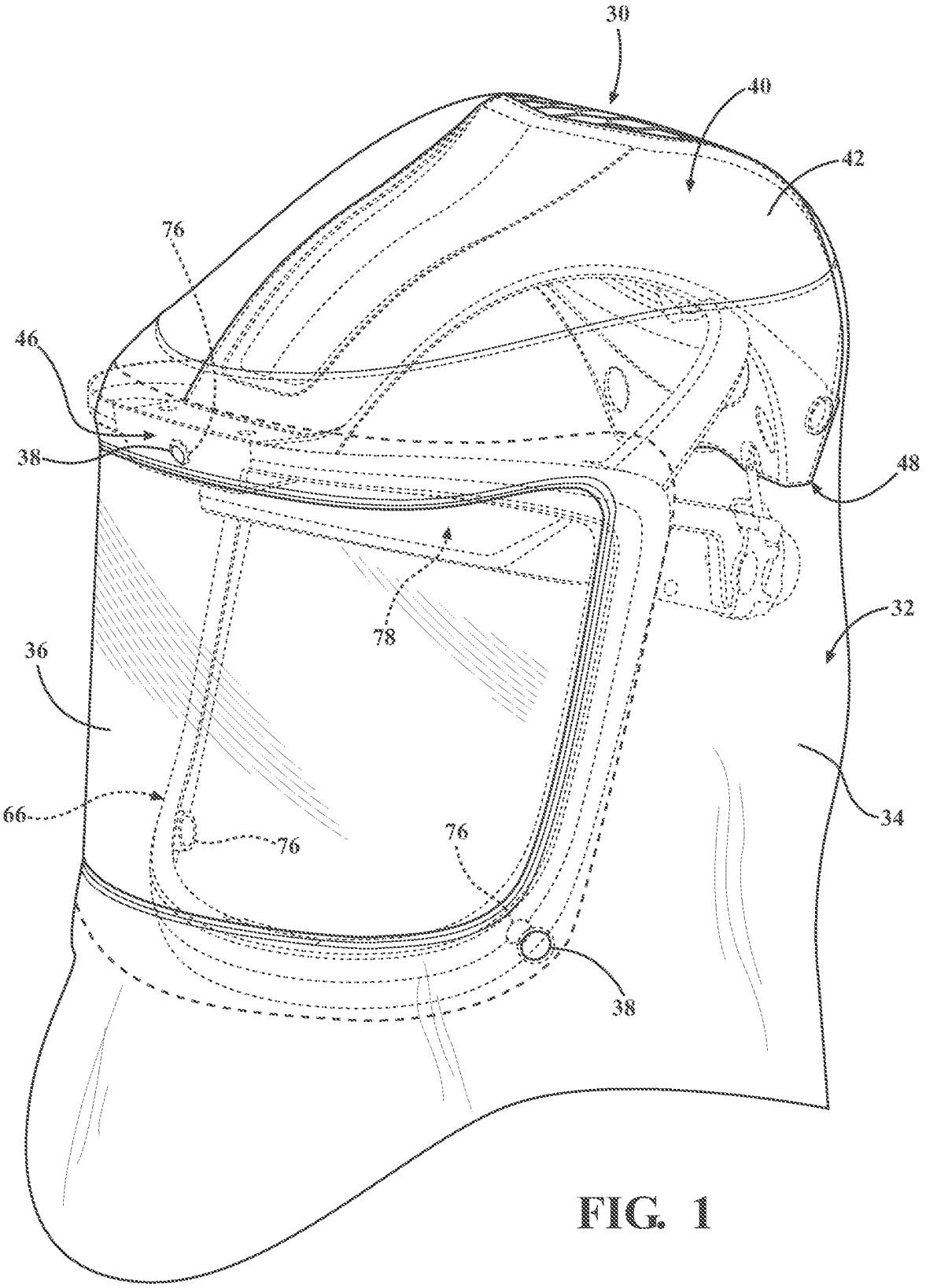
FIG. 1 is a perspective view of a surgical garment coupled to a surgical helmet assembly.

With reference to the drawings, where like numerals are used to designate like structure throughout the several views, a surgical helmet assembly 30 is shown coupled to a surgical garment 32 in FIG. 1 for use during medical and/or surgical procedures. The surgical garment 32 may be configured for attachment to the surgical helmet assembly 30. The surgical garment 32 is configured to provide a barrier, such as a microbial barrier, between the user wearing the surgical garment 32 and the surrounding environment. The barrier created by the surgical garment 32 may benefit both the user and the patient. The barrier provided by the surgical garment 32 may mitigate the likelihood that the user may come into contact with fluid or solid particles of matter from the patient that may be generated during the course of a surgical procedure. The barrier may substantially prevent the transfer of any foreign particles emitted by the user from being transferred to the patient during the surgical procedure. In some instances, particularly those where creating a barrier between the user and the patient is unnecessary, a surgical garment 32 may not be coupled to the surgical helmet assembly 30. Various features of the surgical helmet assembly 30, such as the ventilation system, which is incorporated by reference are described in U.S. Pat. No. 7,735,156.

Referring to FIG. 1, the surgical garment 32 may include a surgical fabric 34 configured to cover the surgical helmet assembly 30 and at least a portion of the head of the user. The surgical garment 32 may be configured as a hood, as illustrated in FIG. 1. It will be understood that the hood refers to a surgical garment 32 that covers the head and likely only extends a short distance below the neck when worn by the user. However, while not illustrated in the figures, it is further contemplated that the surgical garment 32 may be configured as a toga, a shirt, or a jacket. It will be understood that the toga refers to a surgical garment 32 that covers the head in the same manner as a hood and extends to at least the waist when worn by the user.

As illustrated in FIG. 1, the surgical garment 32 may further comprise a face shield 36. The face shield 36 grants visibility to the user without compromising the barrier provided by the surgical garment 32. The face shield 36 has a generally sheet-like structure and may have a thickness of approximately 1 mm or less. It is contemplated that the face shield 36 may have a thickness of more than 1 mm. The face shield 36 may be mounted and/or attached to an opening or cut-out formed in the surgical fabric 34 of the surgical garment 32. The surgical fabric 34 may be attached around the periphery or edge of the face shield 36 by sewing, snaps, hook and loop, adhesive, welding, or combinations thereof. The face shield 36 may be constructed from a transparent material, such as a polycarbonate. One such polycarbonate is sold under the trademark LEXAN™ by Sabic. The face shield 36 of the surgical garment 32 may also be tinted to protect the user's eyes from heightened exposure to bright lights. Furthermore, the face shield 36 may be flexible such that the face shield 36 may be curved to accommodate the shape of the surgical helmet assembly 30.

The surgical garment 32 may also include one or more garment fasteners 38 positioned about the surgical garment 32. The garment fasteners 38 are configured to releasably secure the surgical garment 32 to the surgical helmet assembly 30. The garment fasteners 38 may take any suitable form, and may comprise metal tacks, rivets, buttons, magnets, hook and loop, snaps, or similar types of fasteners, alone or in combination. As illustrated in FIG. 1, the garment fasteners 38 may be mounted to the face shield 36 of the surgical garment 32 so as to extend inwardly from the user side of the face shield 36. While not illustrated in the figures, it is also contemplated that the garment fasteners 38 may be positioned at any other position or location about the surgical garment 32, including being mounted to the surgical fabric 34. The garment fasteners 38 may be mounted to the face shield 36 and/or the surgical fabric 34 via an adhesive, rivet, snap, similar mounting device, or combination thereof. It is contemplated that a surgical garment and fastening arrangement as disclosed in commonly owned WO 2019/147923, filed Jan. 25, 2019, which is hereby incorporated herein by reference in its entirety, may be used in conjunction with the surgical helmet assembly 30.

Figure 2:
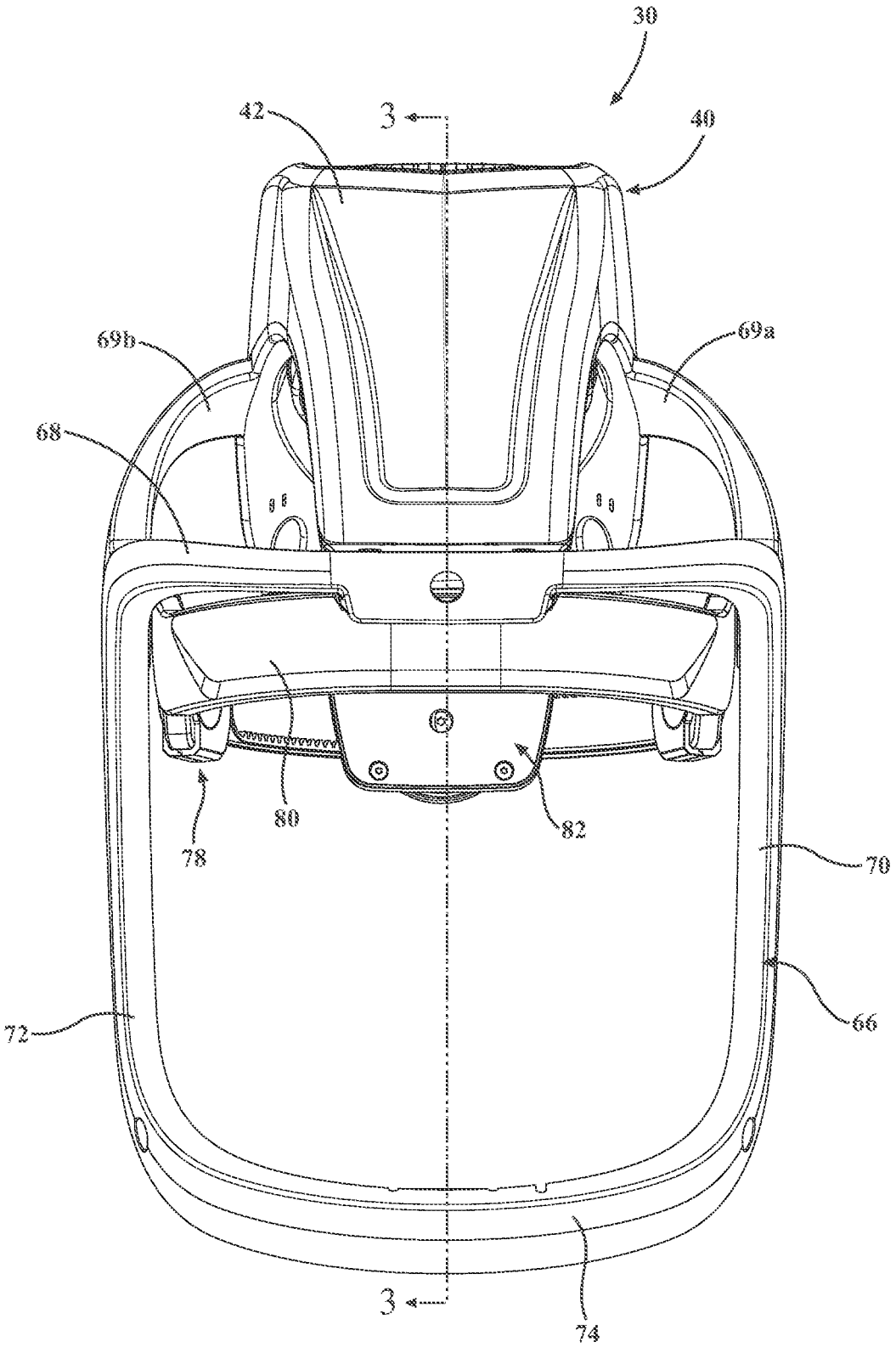
FIG. 2 is a front elevation view of the surgical helmet assembly.
Figure 3:
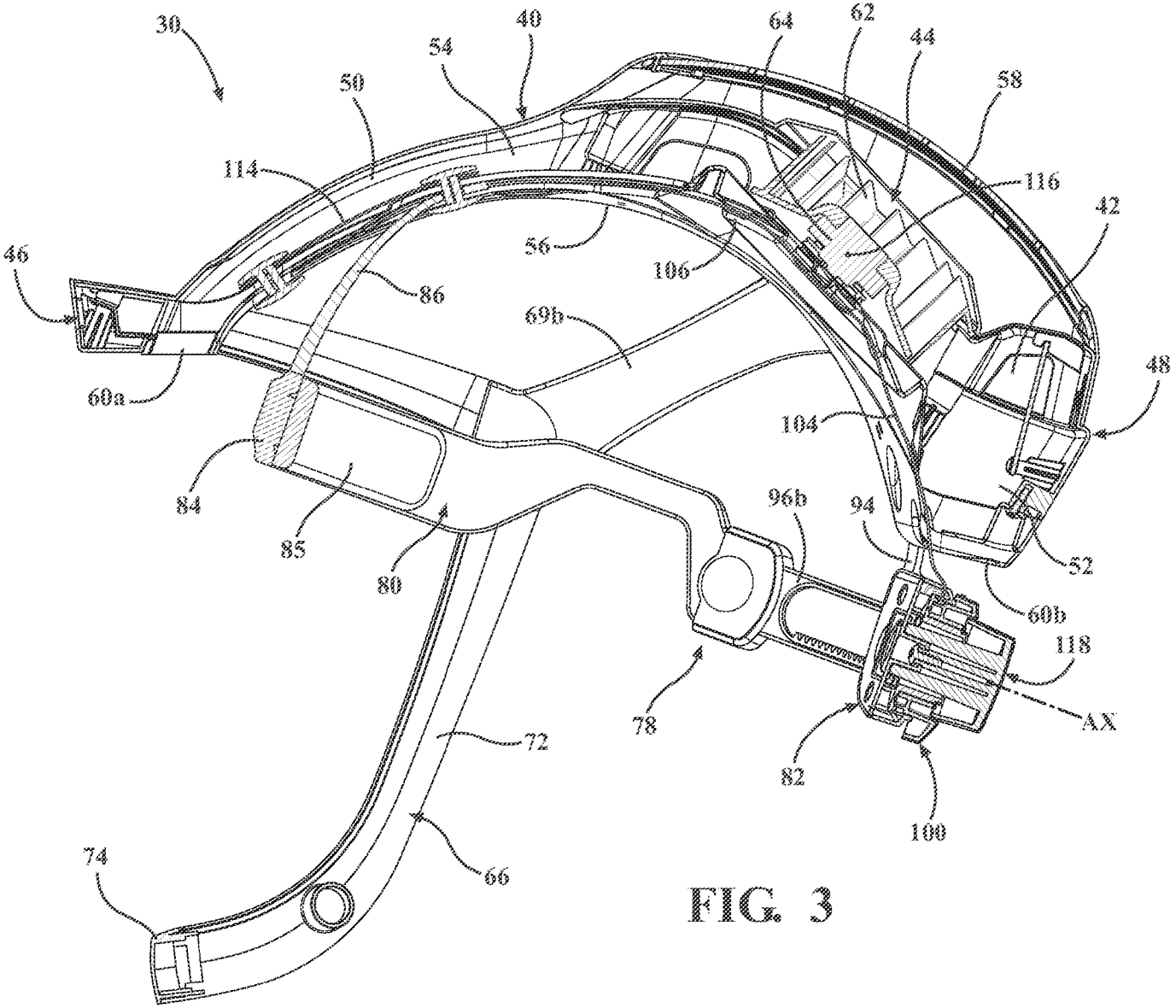
FIG. 3 is a sectional view of the surgical helmet assembly taken along line 3-3 of FIG. 2.
Figure 4:
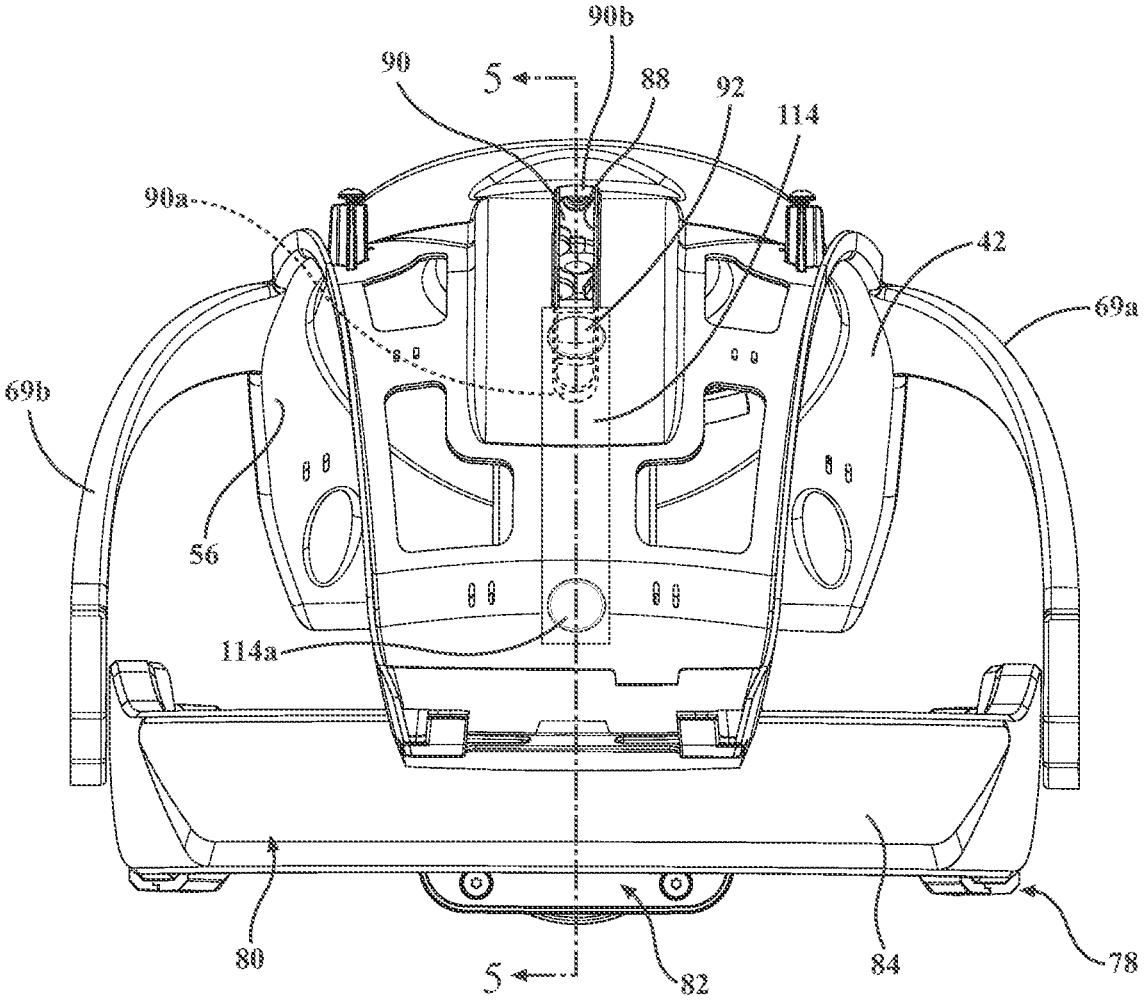
FIG. 4 is a front elevation view of the surgical helmet assembly with a portion of a frame assembly removed.

Referring to FIGS. 1-3, the surgical helmet assembly 30 for mounting to the head of the user during surgical operations is shown. Referring to FIG. 3, the surgical helmet assembly 30 comprises a frame assembly 40. The frame assembly 40 includes a helmet shell 42 generally supported at least partially above the user's head and a ventilation sub-assembly 44 coupled to the helmet shell 42. The helmet shell 42 may be configured in an arcuate shape to fit over the head of the user wearing the surgical helmet assembly 30. Other helmet designs are contemplated. The helmet shell 42 has a first end 46 and a second end 48 opposite the first end 46. The first end 46 is arranged to be adjacent the face shield 36 of the surgical garment 32 when the surgical garment 32 is attached. The helmet shell 42 may comprise a top portion 50 and a bottom portion 52 coupled to the top portion 50. The bottom portion 52 of the helmet shell 42 comprises an interior surface 56 configured to face the user when the surgical helmet assembly 30 is worn by the user. The top and bottom portions 50, 52 of the helmet shell 42 collectively form a duct 54. It is contemplated that the helmet shell 42 may comprise additional portions to form the duct 54. It is also contemplated that the helmet shell 42 may comprise a single portion to form the duct 54. The helmet shell 42 may also define one or more inlet openings 58 and one or more outlet openings 60*a*, 60*b*. The duct 54 of the helmet shell 42 illustrated in FIG. 3 defines one inlet opening 58 and the duct 54 of the helmet shell 42 defines a first outlet opening 60*a* adjacent the first end 46 of the helmet shell 42 and a second outlet opening 60*b* adjacent the second end 48 of the helmet shell 42 (see FIG. 10). The duct 54 acts as a passageway within the helmet shell 42 to permit air to be moved between the inlet opening 58 and the outlet openings 60*a*, 60*b*. The first and second outlet openings 60*a*, 60*b* may also be referred to as first and second "nozzles," as the cross-sectional area of the openings 60*a*, 60*b* may be smaller than the cross-sectional area of the duct 54 at a position of the duct 54 between the fan 62 and the openings 60*a*, 60*b*.

When the user wears the surgical helmet assembly 30 with the surgical garment 32 over the user's head, a buildup of carbon dioxide and increased temperatures can result within the surgical garment 32 from a user's breathing. An increase in temperature underneath the surgical garment 32 can also result in the buildup of water vapor on the user and/or the face shield 36, resulting in the user's view being obstructed. In order to prevent these undesirable effects, the ventilation sub-assembly 44 is employed. The ventilation sub-assembly 44 comprises a fan 62 rotatably coupled to the helmet shell 42 and a motor 64 operatively connected to the fan 62. The motor 64 may be configured to rotate the fan 62 when energized by a power source. The motor 64 may further be configured to receive various commands to control the actuation and/or adjust the rotational speed of the fan 62. In the configuration shown in FIG. 3, the fan 62 and the motor 64 are disposed within the duct 54 of the helmet shell 42. The motor 64 is configured to operate the fan 62 to draw air into the duct 54 through the inlet opening 58 and expel air out of the duct 54 through the outlet openings 60*a*, 60*b*. The duct 54 serves to disperse the air drawn from the inlet opening 58 to the outlet openings 60*a*, 60*b*. More specifically, air dispersed to the first outlet opening 60*a* may be discharged against the face shield 36 or the face of the user and air dispersed to the second outlet opening 60*b* may be discharged against the back of the neck of user. While the ventilation sub-assembly 44 is shown disposed completely within the duct 54 of the helmet shell 42, it is contemplated that the ventilation sub-assembly 44 may be arranged differently. For instance, the ventilation sub-assembly 44 may be removably coupled to the helmet shell 42 such that the ventilation sub-assembly 44 is disposed adjacent the helmet shell 42 or only partially within the duct 54 of the helmet shell 42. In such a configuration, the ventilation sub-assembly 44 may still be configured to draw or force air into the duct 54 through the inlet opening 58 and out of the duct 54 through the outlet openings 60*a*, 60*b*. The fan 62 may comprise a fan blade, an impeller, a propeller, a fan wheel, or a similar blade mechanism configured to induce air movement.

The surgical helmet assembly 30 may comprise a chin bar 66 extending downwardly from the helmet shell 42 to provide structure for the face shield 36 when the surgical garment 32 is attached. The chin bar 66 may comprise a top beam 68 coupled to the first end 46 of the helmet shell 42 and arranged to wrap partially around the face of the user when the surgical helmet assembly 30 is worn. The top beam 68 comprises a first end and a second end. The helmet shell 42 comprises first and second arms 69*a*, 69*b* extending outwardly from a body portion of the helmet shell 42 between the first and second ends 46, 48 of the helmet shell 42 toward the first and second ends of the top beam 68 to provide additional attachment points for rigidity. The chin bar 66 may further comprise a first post 70 and a second post 72. The first post 70 extends downwardly from the top beam 68 adjacent the first end. The second post 72 extends downwardly from the top beam 68 adjacent the second end. A bottom beam 74 spaced below the top beam 68 and may be arranged to extend between and be coupled to the first and second posts 70, 72. The chin bar 66 is formed so that the bottom beam 74 is located below and slightly forward of the chin of the user when the user is wearing the surgical helmet assembly 30. The bottom beam 74 may be bowed outwardly from the first and second posts 70, 72. The chin bar 66 may be constructed from a generally flexible or pliable material.

A plurality of fasteners 76, such as magnets, hook and loop, metal rivets, snaps, or similar type fasteners may be mounted to the chin bar 66 and configured to align and/or attach to the face shield 36 of surgical garment 32. Each fastener 76 may be positioned on the chin bar 66 proximate to where the first and second posts 70, 72 are coupled to the bottom beam 74. Alternatively, the fasteners 76 could be arranged or otherwise configured in any suitable way to cooperate with the complementary garment fasteners 38 of the face shield 36, as described above, to releasably secure the surgical garment 32 to the surgical helmet assembly 30.

The surgical helmet assembly 30 may include one or more electrically-powered peripheral devices (not shown), including but not limited to, a light assembly, a camera, microphone or other communication device, cooling device, or combinations thereof. These devices may be mounted to and/or attached at various locations and orientations relative to the surgical helmet assembly 30. Each of the peripheral devices may be configured to receive commands that affect the operating state of the corresponding peripheral device. For example, each of the peripheral devices may receive on/off commands. Alternatively, the peripheral devices may receive commands that change one or more settings of the peripheral devices. Such configurations allow the user of the surgical helmet assembly 30 to control the operating state of the various peripheral devices during the surgical procedure.

Referring to FIGS. 1 and 4-7, a headband assembly 78 is coupled to the helmet shell 42 for cooperating with the helmet shell 42 to secure the surgical helmet assembly 30 to the user's head. The top portion 50 of the helmet shell 42, the ventilation sub-assembly 44, and chin bar 66 have been removed in FIGS. 4-7 to better illustrate features relating to fitting the surgical helmet assembly 30 to the head of the user. The headband assembly 78 comprises a front support member 80 movably coupled to the helmet shell 42 adjacent the first end 46 of the helmet shell 42 and a rear support member 82 coupled to the helmet shell 42 adjacent the second end 48 of the helmet shell 42. The front support member 80 is configured to abut the forehead of the user when the surgical helmet assembly 30 is worn. Arranged opposite the front support member 80, the rear support member 82 is configured to abut a rear region of the head of the user when the surgical helmet assembly 30 is worn. As noted above, the interior surface 56 of the helmet shell 42 is configured to abut the top of the user's head when the surgical helmet assembly 30 is worn. In some configurations, a padding 85 or liner is disposed on one or more of the front support member 80, the rear support member 82, and the helmet shell 42 to provide cushioning for the user. It should be appreciated that the surgical helmet assembly 30 may be utilized without the specific chin bar 66 described here, or without a chin bar entirely.

The front support member 80 comprises a base portion 84 configured to abut the forehead of the user. The front support member 80 further comprises a leg portion 86 extending from the base portion 84. The leg portion 86 is movably coupled to the helmet shell 42 adjacent the first end 46 of the helmet shell 42. The front support member 80 is movable relative to the helmet shell 42 to adjust a sagittal fit of the headband assembly 78 and the helmet shell 42 to the user. In the configuration shown in FIGS. 4-7, the helmet shell 42 comprises an internal surface 88 defining a slot 90. The slot 90 has a first end 90*a*, which may be proximal to the first end 46 of the helmet shell 42 and a second end 90*b* distal to the first end 46 of the helmet shell 42. The leg portion 86 of the front support member 80 comprises a projection 92 extending into the slot 90. In the illustrated configurations, the projection 92 is part of a fastener that couples the leg portion 86 to the helmet shell 42. It is contemplated that the projection 92 could instead be integrally formed with the leg portion 86. The slot 90 receives at least a portion of the projection 92 to constrain the relative movement of the front support member 80 to the helmet shell 42. It is contemplated that the leg portion 86 of the front support member 80 may define the slot 90 and the helmet shell 42 could comprise the projection 92 to provide a coupling between the front support member 80 and the helmet shell 42.

In other configurations, the fastener may comprise a sliding block (not shown) that may be movably coupled to the helmet shell 42. The sliding block may be constrained to move within the slot 90 between the first and second ends 90*a*, 90*b* of the slot 90. The projection 92 may be coupled to the sliding block. In this configuration, movement of the front support member 80 relative to the helmet shell 42 is constrained by movement of the sliding block within the slot 90. The sliding block may mitigate the amount of friction produced when the leg portion 86 of the front support member 80 slides relative the helmet shell 42 when the fastener moves within the slot 90.

Movement of the front support member 80 relative to the helmet shell 42 is described in greater detail further below. The base portion 84 of the front support member 80 is formed to wrap at least partially around the forehead of the user. The front support member 80 may comprise a flexible or pliable material for permitting the front support member 80 to accommodate heads of differing shapes.

The rear support member 82 may comprise one or more fingers 94 extending from a first portion of the rear support member 82 and coupled to the helmet shell 42. The fingers 94 of the rear support member 82 permit hinging movement of the rear support member 82 relative to the helmet shell 42. The fingers 94 may comprise a flexible or pliable material to provide for the hinging relationship between the helmet shell 42 and the rear support member 82. Alternatively, the fingers 94 may be rotatably coupled to the helmet shell 42 to provide for the hinging relationship between the helmet shell 42 and the rear support member 82.

The headband assembly 78 may further comprise a pair of straps 96*a*, 96*b* coupled to the base portion 84 of the front support member 80 and movably coupled to the rear support member 82. In certain configurations, the base portion 84 of the front support member 80, the pair of straps 96*a*, 96*b*, and the rear support member 82 collectively form a continuous loop to circumferentially surround the head of the user. The pair of straps 96*a*, 96*b* are movable relative to the rear support member 82 to adjust a size of the continuous loop to accommodate circumferences of different head sizes. Movement of the pair of straps 96*a*, 96*b* relative to the rear support member 82 is discussed in greater detail further below. It is contemplated that alternative strap configurations are possible, such as those systems utilizing a single strap.

Figure 5:
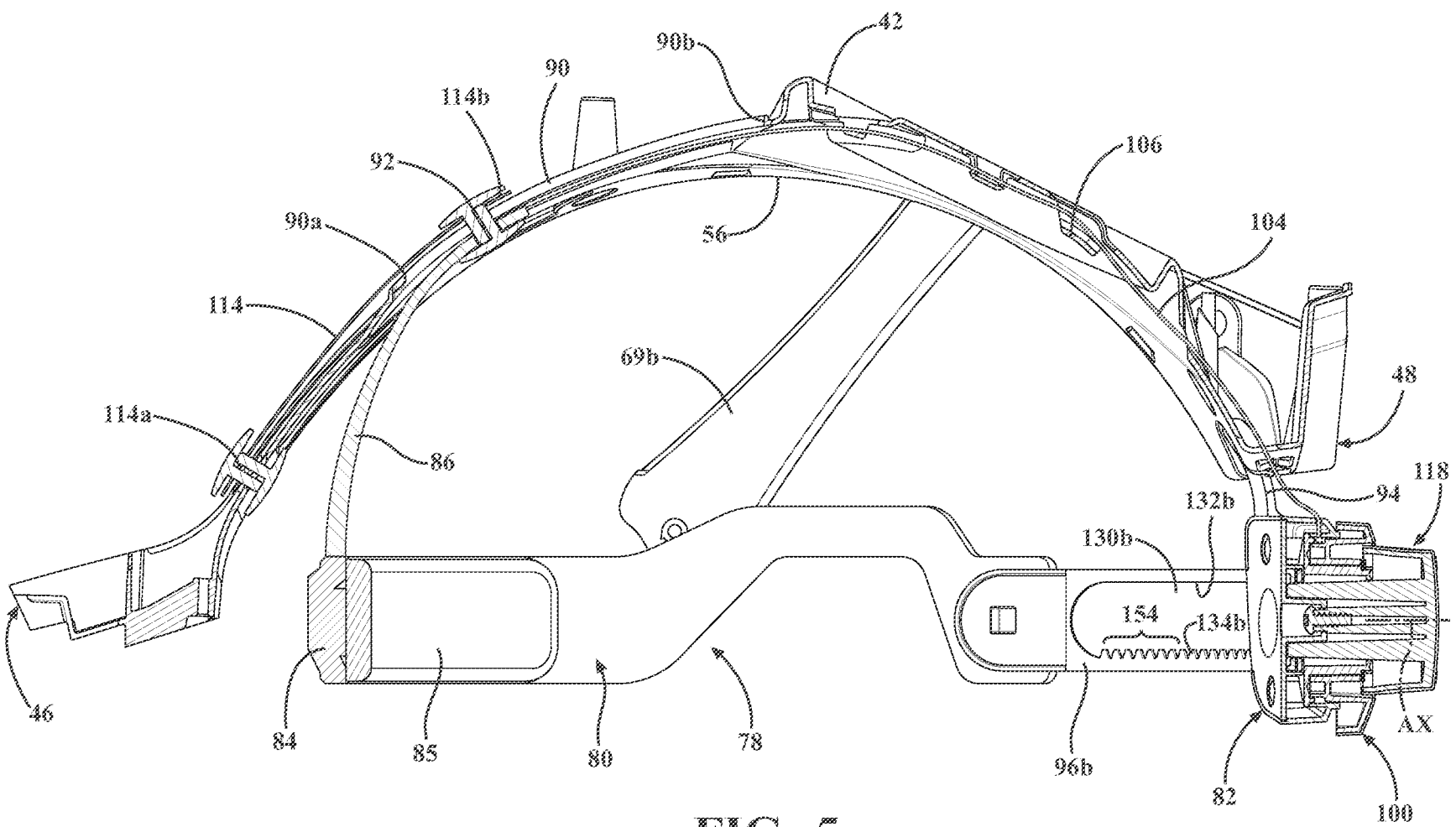
FIG. 5 is a sectional view of the surgical helmet assembly of FIG. 4 taken along line 5-5 of FIG. 4 with a front support member in a first position.

Referring to FIG. 5, the surgical helmet assembly 30 comprises a first adjustment assembly 100, hereinafter referred to as a sagittal adjustment assembly 100. The sagittal adjustment assembly 100 serves to adjust a sagittal fit of the surgical helmet assembly 30 to the user's head. More specifically, the sagittal adjustment assembly 100 changes the relative position of the front support member 80 to the helmet shell 42 to accomplish sagittal adjustment. The sagittal adjustment assembly 100 comprises a sagittal actuation member 102 rotatably coupled to the rear support member 82. In other configurations, the sagittal actuation member 102 may be rotatably coupled to the helmet shell 42. The sagittal actuation member 102 is rotatable about an actuation axis AX. The sagittal adjustment assembly 100 further comprises a tension element 104. The tension element 104 has a first end operatively connected to the sagittal actuation member 102 and a second end coupled to the front support member 80. In the illustrated configurations, the second end of the tension element 104 is coupled to the projection 92 of the leg portion 86 of the front support member 80. It is contemplated that the tension element 104 could be coupled to another part of the leg portion 86 or part of the base portion 84 of the front support member 80.

The helmet shell 42 may comprise a tension element guide 106 disposed between the first and second ends 46, 48 of the helmet shell 42. The tension element guide 106 may comprise a hook or an annular structure defining at least one of a groove, a channel, and a cavity to at least partially receive the tension element 104. In this manner, the tension element guide 106 serves to navigate the tension element 104 between the sagittal actuation member 102 and the front support member 80 without compromising functionality of the ventilation sub-assembly 44 or the peripheral devices and without contacting the head of the user. The tension element 104 is movable relative to the helmet shell 42 and the tension element guide 106 in response to rotation of the sagittal actuation member 102. In this manner, rotation of the sagittal actuation member 102 moves the tension element 104 to effect changes in position of the front support member 80 relative to the helmet shell 42.

Figure 6:
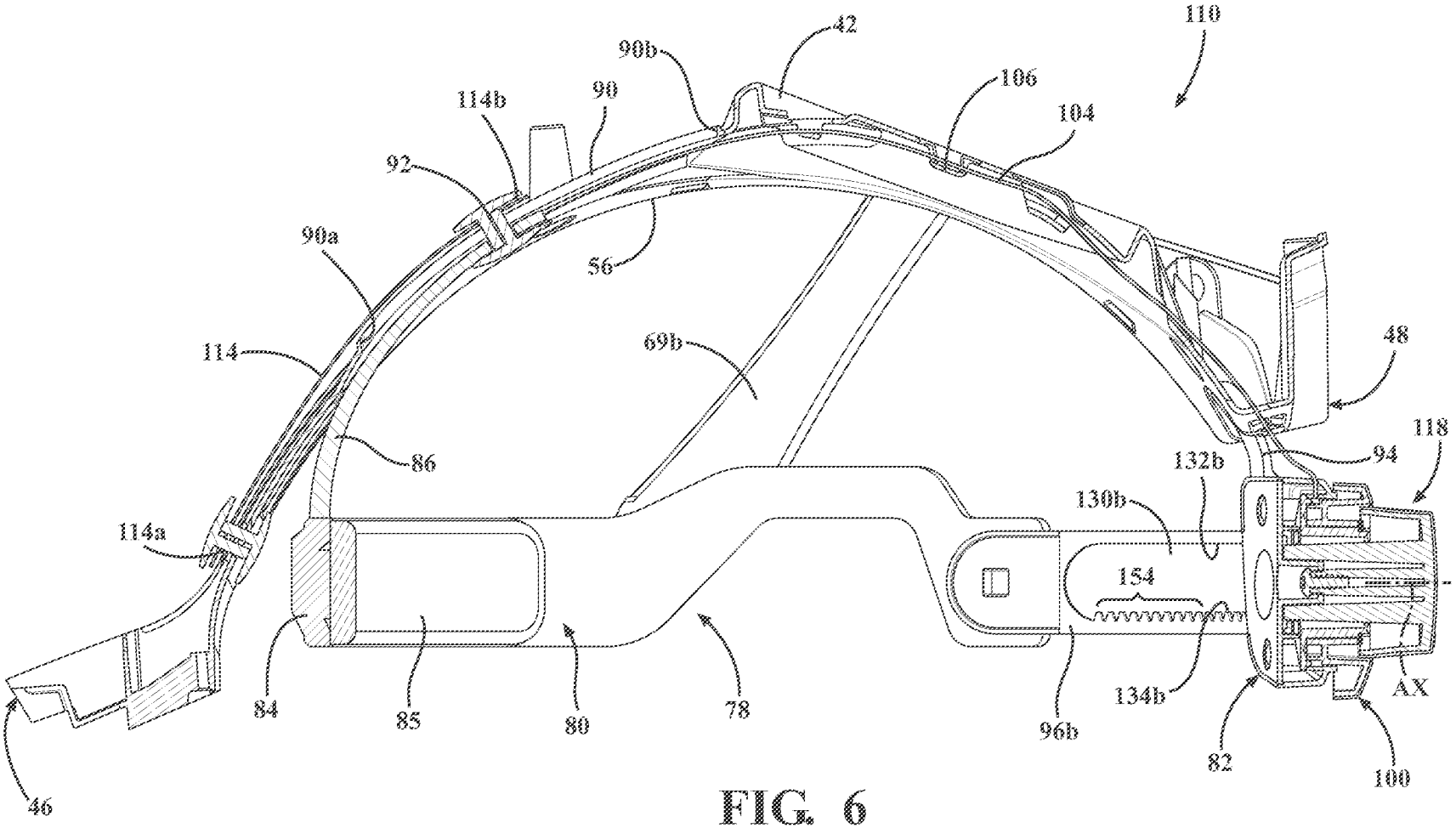
FIG. 6 is another sectional view of the surgical helmet assembly of FIG. 4 with the front support member in a second position.
Figure 7:
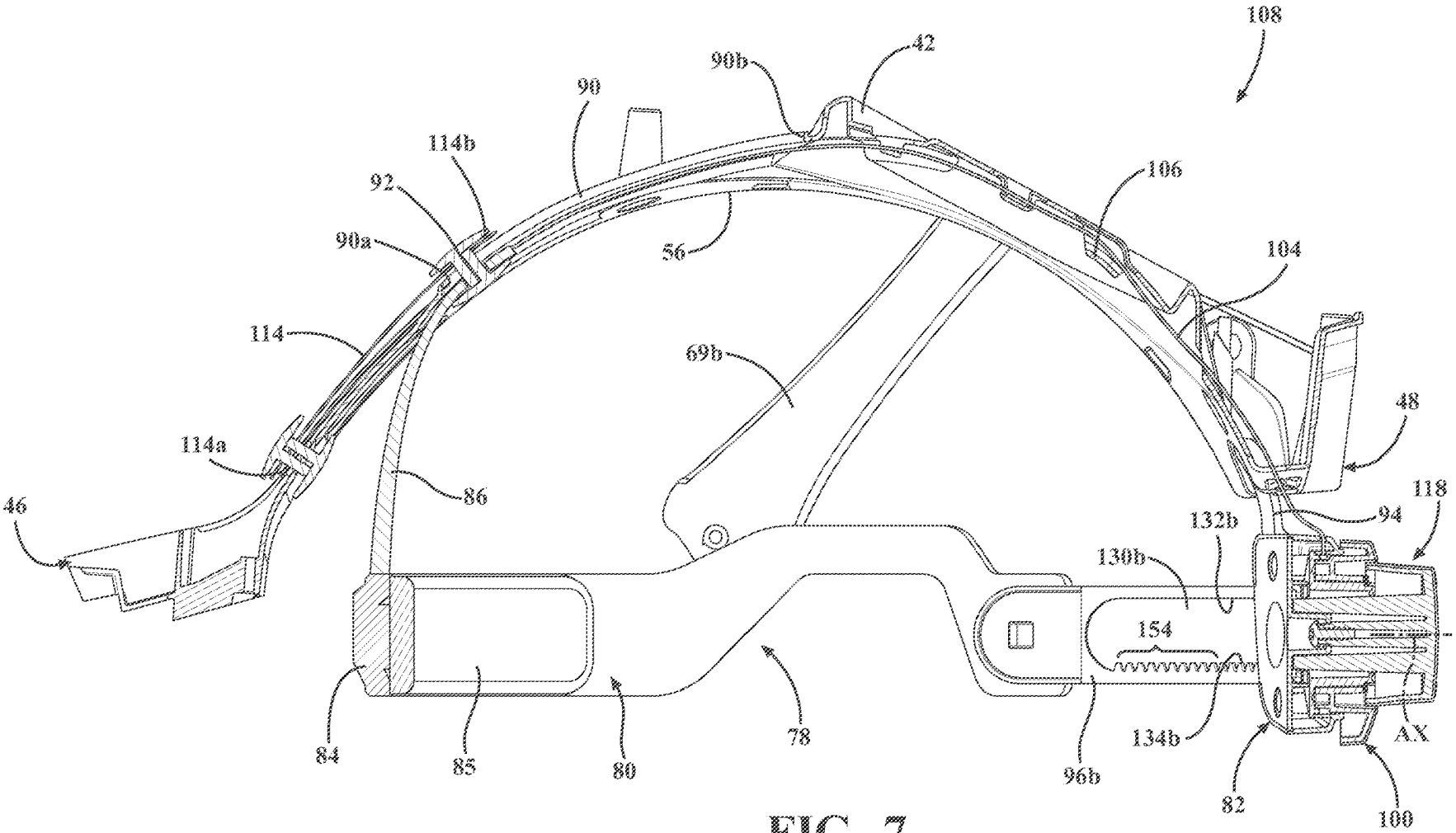
FIG. 7 is another sectional view of the surgical helmet assembly of FIG. 4 with the front support member in a third position.
Figure 8:
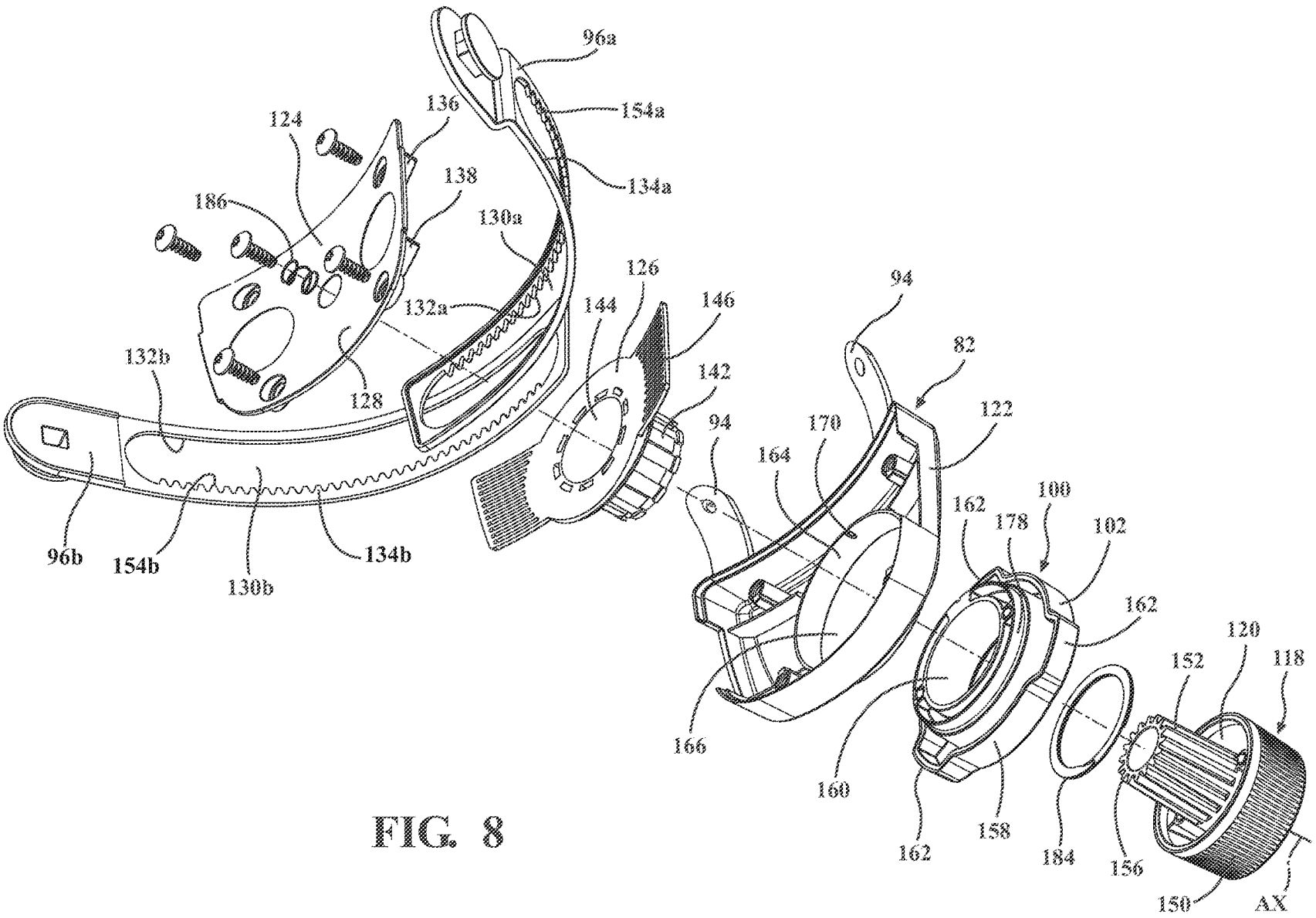
FIG. 8 is an exploded perspective view of a portion of the surgical helmet assembly.
Figure 9:
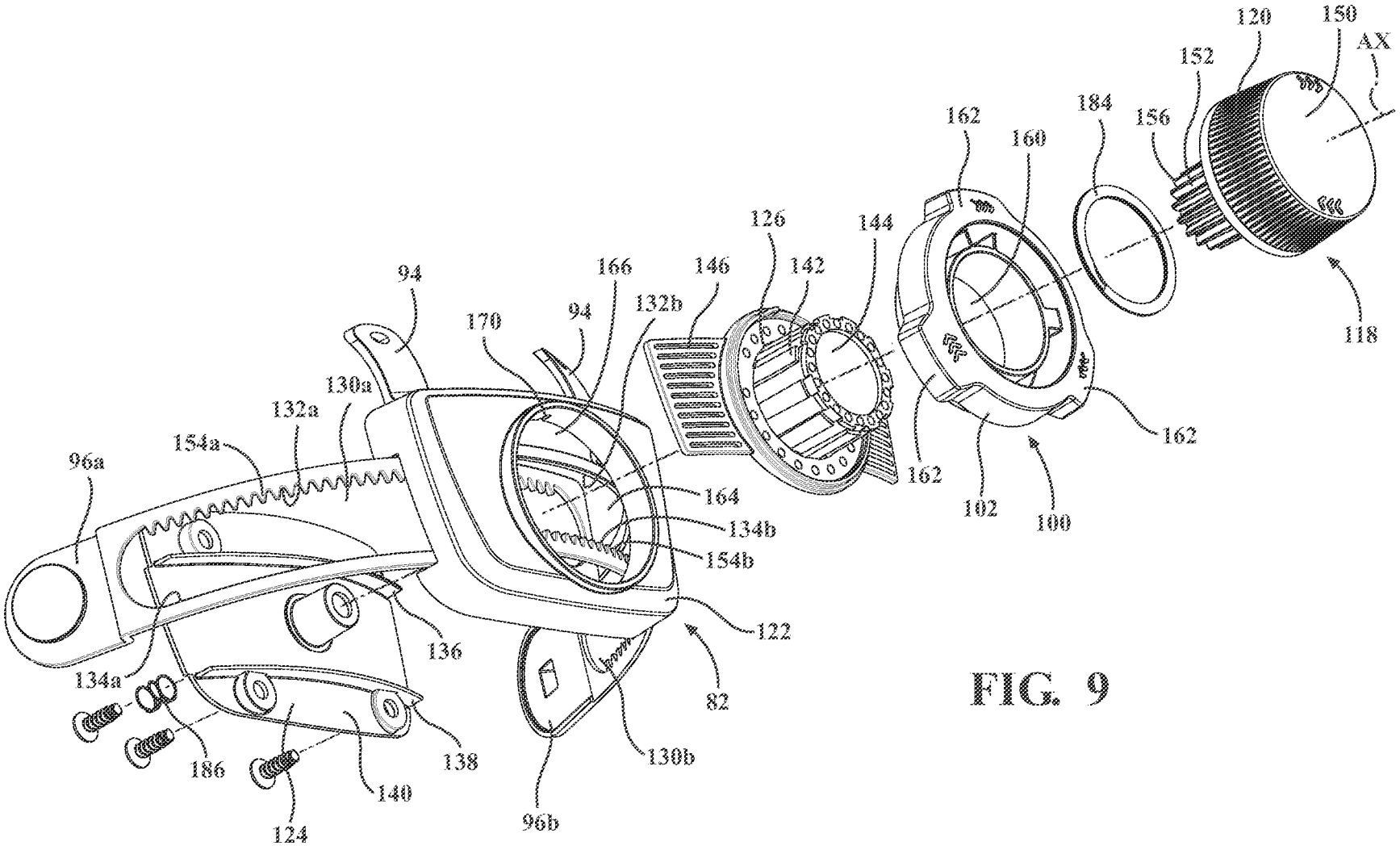
FIG. 9 is another exploded perspective view of the portion of the surgical helmet assembly in FIG. 8.

As shown in FIGS. 5-7, the front support member 80 is moveable relative to the helmet shell 42 to a first position 108 (FIG. 7), a second position 110 (FIG. 6), and one or more intermediate positions therebetween (one shown in FIG. 5). The changes in position of the front support member 80 to the helmet shell 42 changes a head receiving volume bounded between the continuous loop of the headband assembly 78 and the interior surface 56 of the helmet shell 42. Further, the changes in position of the front support member 80 to the helmet shell 42 changes a distance between a center of mass of the frame assembly 40 and the base portion 84 of the front support member 80. Changes in volume and the location of the center of mass are discussed further below in greater detail. As noted above, the projection 92 of the leg portion 86 of the front support member 80 is moveable within the slot 90 when the front support member 80 moves relative to the helmet shell 42. Thus, the projection 92 is moveable within the slot 90 via the tension element 104 from rotation of the sagittal actuation member 102. The projection 92 is adapted to be adjacent the first end 90*a* of the slot 90 when the front support member 80 is in the first position 108. The projection 92 is further adapted to be adjacent the second end 90*b* of the slot 90 when the front support member 80 is in the second position 110. In some configurations, the arrangement of the projection 92 at one or both the first and second ends 90*a*, 90*b* of the slot 90 serves to define one or both the first and second positions 108, 110 of the front support member 80, respectively. Said differently, in some configurations, the projection 92 abuts one of the first and second ends 90*a*, 90*b* of the slot 90 when the front support member 80 is in one of the first and second positions 108, 110, respectively. In other configurations, the projection 92 does not abut either of the first and second ends 90*a*, 90*b* of the slot 90 when the front support member 80 is in the first and second positions 108, 110, but instead is intermediate the first and second ends 90*a*, 90*b* of the slot 90.

A biasing mechanism 114 may be coupled to the helmet shell 42 and the front support member 80 to bias the front support member 80 toward the first position 108. The biasing mechanism 114 may also serve to keep the tension element 104 taut when the sagittal actuation member 102 would otherwise permit slack in the tension element 104. In the illustrated configurations, the biasing mechanism 114 comprises an elastic member, such as a strap, having a first end 114*a* coupled adjacent the first end 46 of the helmet shell 42 and a second end 114*b* coupled to the projection 92 of the leg portion 86 of the front support member 80. The biasing mechanism 114 is configured to bias the projection 92 toward the first end 90*a* of the slot 90. In alternative configurations, the biasing mechanism 114 may be coupled to the base portion 84 or another part of the leg portion 86 to bias the projection 92 toward the first end 90*a* of the slot 90.

Referring to FIGS. 6 and 7 and as noted above, a head receiving volume in a hemispherical-like shape is bounded between the continuous loop of the headband assembly 78 on the bottom and the interior surface 56 of the helmet shell 42 on the top. When the front support member 80 is in the first position 108 (see FIG. 7), the first position 108 defines a first head receiving volume. When the front support member 80 is in the second position 110 (see FIG. 6), the second position 110 defines a second head receiving volume. The first head receiving volume is larger than the second head receiving volume. The change in volume permits the surgical helmet assembly 30 to accommodate a plurality of head sizes while retaining the interior surface 56 of the helmet shell 42 in close proximity to the head of the user when the front support member 80 moves between the first position 108, the second position 110, and the one or more intermediate positions. More specifically, a user may adjust the sagittal actuation member 102 to adjust a sagittal fit of the surgical helmet assembly to accommodate a larger head in the first position 108 of the front support member 80 than in the second position 110 of the front support member 80.

As noted above, the frame assembly 40 has a center of a mass generally indicated at 116 and shown in FIG. 3. FIG. 3 shows the center of mass 116 of one configuration of the frame assembly 40. The precise location of the center of mass 116 may be different in other configurations based on weight distribution of the components of the frame assembly 40. One advantage of using the helmet shell 42 and front support member 80 to change the volume bounded between the continuous loop of the headband assembly 78 and the interior surface 56 of the helmet shell 42 is keeping the center of mass 116 of the frame assembly 40 in close proximity to the head of the user. Although not shown in FIGS. 4-7, it is appreciated that the relative position of the center of mass 116 to the helmet shell 42 shown in FIG. 3 remains the same in FIGS. 5-7. When the front support member 80 is in the first position 108 (see FIG. 7), the center of mass 116 of the frame assembly 40 is at a first distance from the base portion 84 of the front support member 80. When the front support member 80 is in the second position 110 (see FIG. 6), the center of mass 116 of the frame assembly 40 is at a second distance from the base portion 84 of the front support member 80. The first distance is greater than the second distance. The change in distance between the base portion 84 of the front support member 80 and the center of mass 116 of the frame assembly 40 when adjusting a sagittal fit to the head of the user permits the center of mass 116 of the frame assembly 40 to remain in close proximity to the head of the user. As a result of keeping the center of mass 116 of the frame assembly 40 in close proximity to the user's head, the moment of inertia of the frame assembly 40 on the head of the user is reduced when the user moves their head while wearing the surgical helmet assembly 30. Reducing the moment of inertia of the frame assembly 40 on the head of the user mitigates stress exerted on the user's body while the user is wearing the surgical helmet assembly 30. Keeping the center of mass 116 of the frame assembly 40 in close proximity to the head of the user when the front support member 80 is in the first position 108, the second position 110, and the one or more intermediate positions mitigates variation of the moment of inertia between users having different head sizes.

Figure 11:
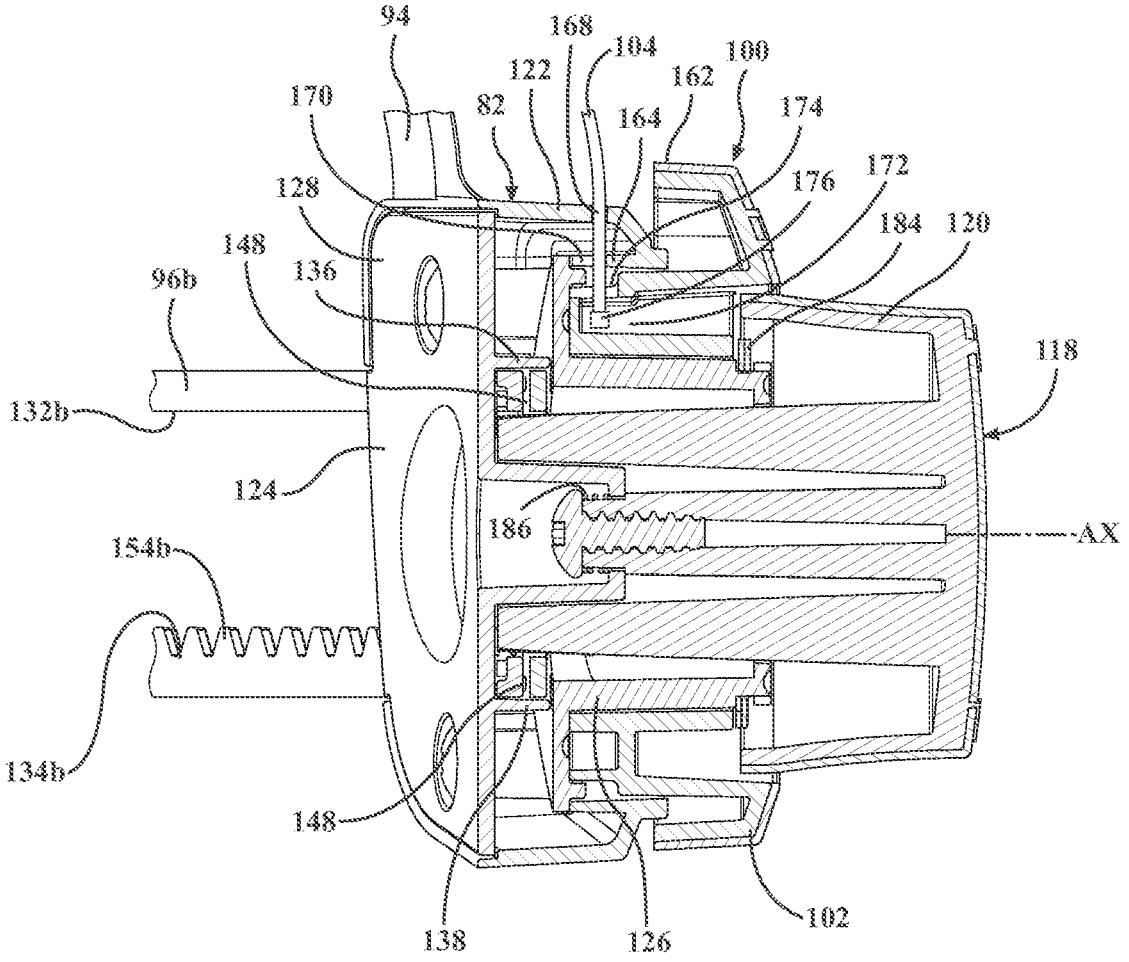
FIG. 11 is a sectional view of the headband assembly and the two adjustment assemblies of the surgical helmet assembly taken along line 11-11 of FIG. 10.

As shown in FIG. 11, the surgical helmet assembly 30 may further comprise a second or circumferential adjustment assembly 118 coupled to the rear support member 82. The second or circumferential adjustment assembly 118 is configured to adjust a circumferential fit of the headband assembly 78 to the head of the user. The second or circumferential adjustment assembly 118 comprises a circumferential actuation member 120 rotatably coupled to the rear support member 82. The circumferential actuation member 120 is arranged to engage at least one strap of the pair of straps 96*a*, 96*b*. In the illustrated configurations, the circumferential actuation member 120 is arranged to engage both of the straps 96*a*, 96*b*. The straps 96*a*, 96*b* are movable relative to the rear support member 82 to adjust a size of a perimeter defined by the continuous loop of the headband assembly 78 in response to rotation of the circumferential actuation member 120. In the illustrated configurations, the circumferential actuation member 120 and the sagittal actuation member 102 are concentric such that the circumferential actuation member 120 is also rotatable about the actuation axis AX. One advantage of employing concentric actuation members 102, 120 is centralizing the location of the two adjustment assemblies 100, 118. This may have the benefit of increasing the ease of access by the user to adjust both a sagittal fit and a circumferential fit. A further benefit of centralizing the location of the two adjustment assemblies 100, 118 is the efficient packaging of the adjustment assemblies that may take up less space than if the two adjustment assemblies 100, 118 were employed separately. The efficient packaging may be beneficial for access to repair or replace components of the adjustment assemblies 100, 118.

Figure 10:
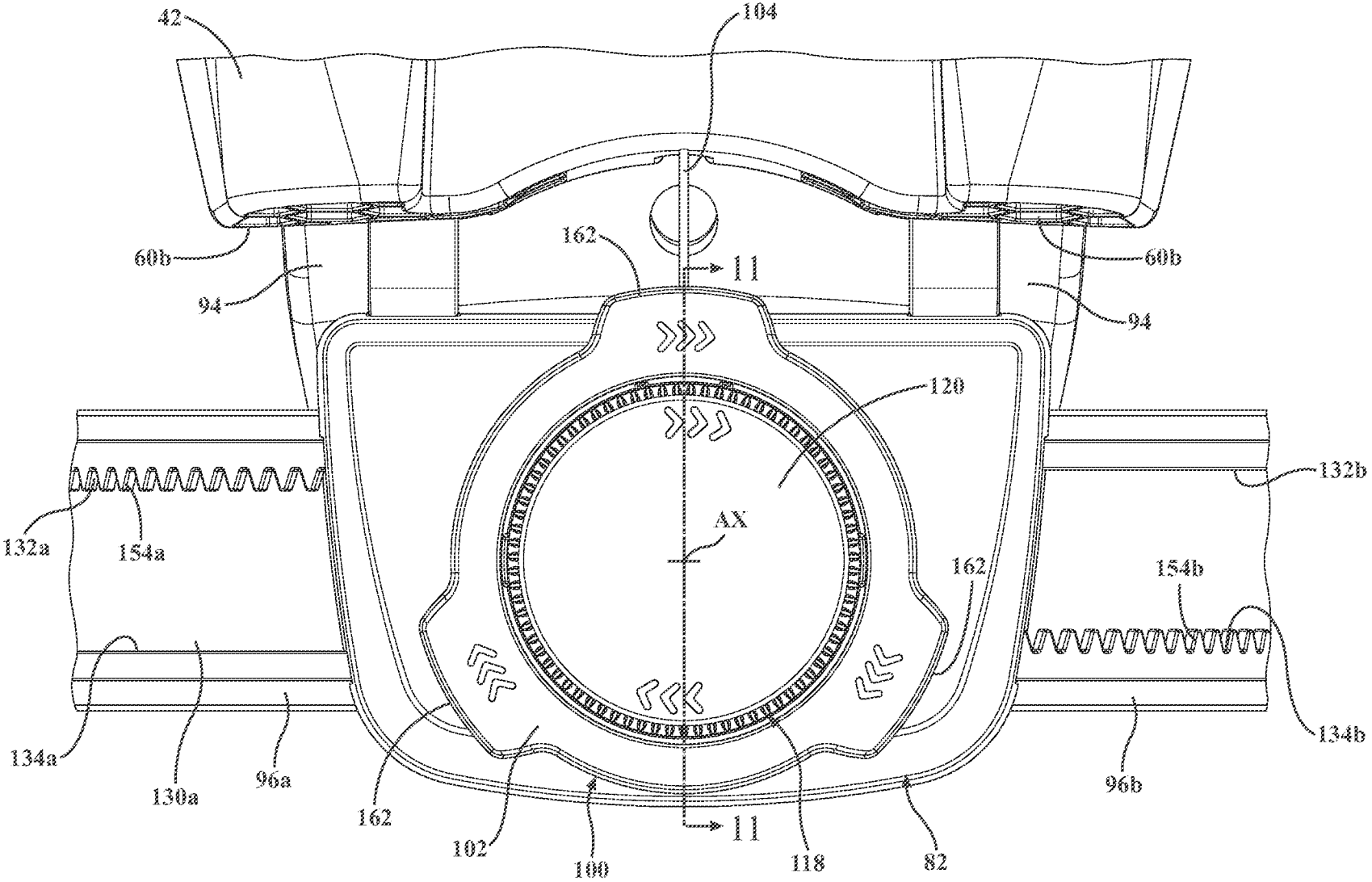
FIG. 10 is a rear elevation view of a headband assembly and two adjustment assemblies of the surgical helmet assembly.

As shown in FIGS. 10 and 11, the sagittal actuation member 102 extends outwardly from the actuation axis AX farther than the circumferential actuation member 120. The circumferential actuation member 120 extends axially away from the rear support member 82 farther than the sagittal actuation member 102. It is contemplated that the actuation members 102, 120 may have other configurations that assist the user in differentiating the sagittal actuation member 102 from the circumferential actuation member 120 i.e., different sizes or shapes from one another. The actuation members 102, 120 may comprise a knob, a dial, or another physical structure that may be grasped by a user for rotation or translation.

Referring to FIGS. 8-11, the rear support member 82 may comprise a first portion 122 coupled to the helmet shell 42, a second portion 124 coupled to the first portion 122, and an intermediate portion 126 disposed between the first and second portions 122, 124. The second portion 124 comprises an interior surface 128 facing the user when the user is wearing the surgical helmet assembly 30. The portions 122, 124, 126 of the rear support member 82 may cooperate to assist in functionality of the adjustment assemblies 100, 118. Specifically the portions 122, 124, 126 may cooperate to provide structure for guiding the pair of straps 96*a*, 96*b* to engagement with the circumferential actuation member 120. Further, the portions 122, 124, 126 may cooperate with each other and the actuation members 102, 120 to assist in retaining radial positions of the actuation members 102, 120. The portions 122, 124, 126 of the rear support member 82 are shown in FIGS. 8-11 as being individual components assembled together. However, it is contemplated that one or more of the portions 122, 124, 126 may be formed from a single integrated component. In other words, the one or more of the portions 122, 124, 126 may be monolithic.

As shown in FIGS. 8-11, each of the straps 96*a*, 96*b* define a slot 130*a*, 130*b* to receive the circumferential actuation member 120. Each of the slots 130*a*, 130*b* is defined by a top surface 132*a*, 132*b*, a bottom surface 134*a*, 134*b*, and ends. The second portion 124 of the rear support member 82 comprises a first ridge 136 and a second ridge 138 spaced from the first ridge 136. The first and second ridges 136, 138 extend away from a surface 140 opposite the interior surface 128. The intermediate portion 126 of the rear support member 82 may comprise a body 142, shown as a generally cylindrical body, extending along the actuation axis AX and defining an aperture 144 for receiving the circumferential actuation member 120. The intermediate portion 126 comprises a wall 146 extending generally transverse to the actuation axis AX away from the body 142 at one end of the body 142. The first and second ridges 136, 138 of the second portion 124 of the rear support member 82 abut the wall 146 of the intermediate portion 126 of the rear support member 82 to form a channel 148 (see FIG. 11). The channel 148 is configured to receive each of the straps 96*a*, 96*b* and guide the straps 96*a*, 96*b* into engagement with the circumferential actuation member 120. It is contemplated that the first and second ridges 136, 138 could be formed on the wall 146 of the intermediate portion 126 of the rear support member 82 and abut the second portion 124 of the rear support member 82 to form the channel 148.

The engagement between the circumferential actuation member 120 and the pair of straps 96*a*, 96*b* may be a rack and pinion engagement. The circumferential actuation member 120 may comprise an actuation portion 150 that is graspable by the user to rotate the circumferential actuation member 120 and that extends away from the first portion 122 of the rear support member 82. The circumferential actuation member 120 may also comprise an engagement portion 152 extending within the aperture 144 of the intermediate portion 126 toward the second portion 124 to engage the straps 96*a*, 96*b* in the channel 148 defined by the second portion 124 of the rear support member 82 and the intermediate portion 126 of the rear support member 82. The top surface 132*a* of the slot 130*a* of one of the straps 96*a* and the bottom surface 134*b* of the slot 130*b* of the other strap 96*b* each comprise a plurality of teeth 154*a*, 154*b* arranged linearly along their respective top and bottom surfaces 132*a*, 134*b*. The engagement portion 152 of the circumferential actuation member 120 comprises a plurality of teeth 156 arranged circumferentially to engage the plurality of teeth 154*a*, 154*b* on the straps 96*a*, 96*b*. When the circumferential actuation member 120 is rotated, the teeth 156 of the engagement portion 152 engage the teeth 154*a*, 154*b* of the straps 96*a*, 96*b* to move the straps 96*a*, 96*b* within the channel 148 relative to each other and the circumferential actuation member 120. Movement of the straps 96*a*, 96*b* in the channel 148 results in a change to the perimeter of the continuous loop of the headband assembly 78. Changes to the perimeter of the continuous loop adjust the circumferential fit of the headband assembly 78 to the head of the user.

As shown in FIGS. 14-16B, the sagittal actuation member 102 may comprise a body 158, shown as a generally cylindrical body, defining an aperture 160 for receiving at least part of the circumferential adjustment member 120 and at least part of the body 142 of the intermediate portion 126 of the rear support member 82. The circumferential adjustment member 120 is removed in FIGS. 14-16B to better illustrate the features and operation of the sagittal actuation member 102. The sagittal actuation member 102 may comprise one or more protrusions 162 extending outwardly from the actuation axis AX and the body 158 of the sagittal actuation member 102 to provide the user more purchase in rotating the sagittal actuation member 102.

As shown in FIGS. 8-11, the first portion 122 of the rear support member 82 may comprise a flange 164 defining an aperture 166 for receiving at least a portion of the circumferential actuation member 120 and at least a portion of the sagittal actuation member 102. Referring to FIG. 11, the first portion 122 of the rear support member 82 may define an opening 168 for receiving the tension element 104. The flange 164 may define a slot 170 in communication with the aperture 166 and the opening 168 for guiding the tension element 104 from the opening 168 to the sagittal actuation member 102.

As shown in FIGS. 14-16B, the sagittal actuation member 102 defines a pocket 172 for receiving the tension element 104. The sagittal actuation member 102 further defines an opening 174 in communication with the pocket 172 and the aperture 166 defined by the flange 164 of the first portion 122 of the rear support member 82 to permit the tension element 104 to be routed from the slot 170 and into the pocket 172. In the illustrated configurations, the tension element 104 comprises a stud 176 at the first end of the tension element 104. The stud 176 secures the first end of the tension element 104 in the pocket 172 of the sagittal actuation member 102 such that the tension element 104 is coupled to the sagittal actuation member 102 at a point radially spaced from the actuation axis AX. The sagittal actuation member 102 comprises a winding surface 178 (see FIG. 16) arranged to face the flange 164. The winding surface 178 is configured to abut at least a portion of the tension element 104 when the sagittal actuation member 102 is rotated. Said differently, at least a portion of the tension element 104 is configured to wind and unwind on the winding surface 178 of the sagittal actuation member 102 in response to rotation of the sagittal actuation member 102. It is contemplated that the tension element 104 could be coupled to the sagittal actuation member 102 in another manner, so long as the tension element 104 is configured to wind and unwind in response to rotation of the sagittal actuation member 102.

Figure 14:
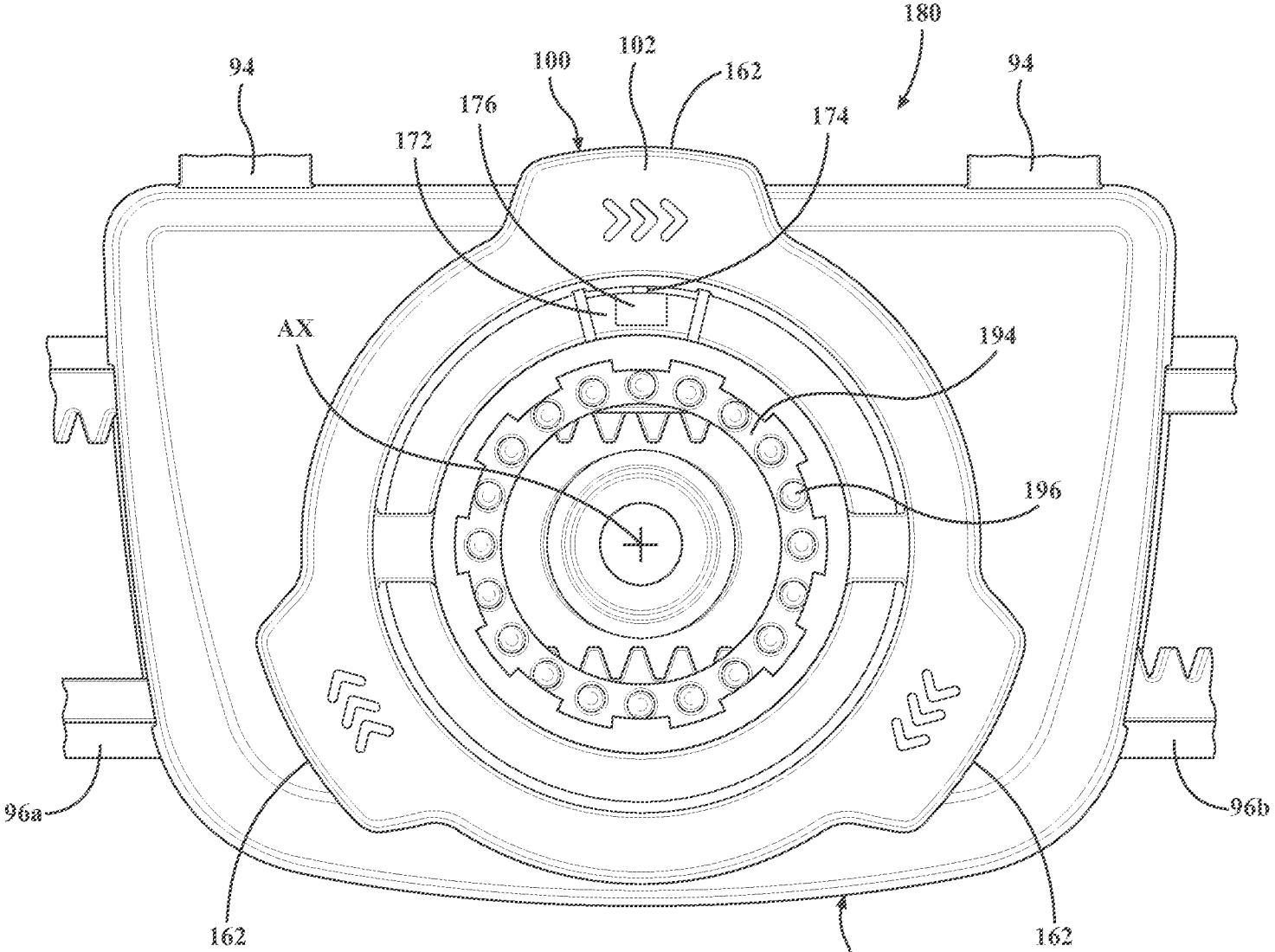
FIG. 14 is another rear elevation view of the headband assembly and the two adjustment assemblies of the surgical helmet assembly with one actuation member removed and another actuation member in a first orientation.
Figure 15:
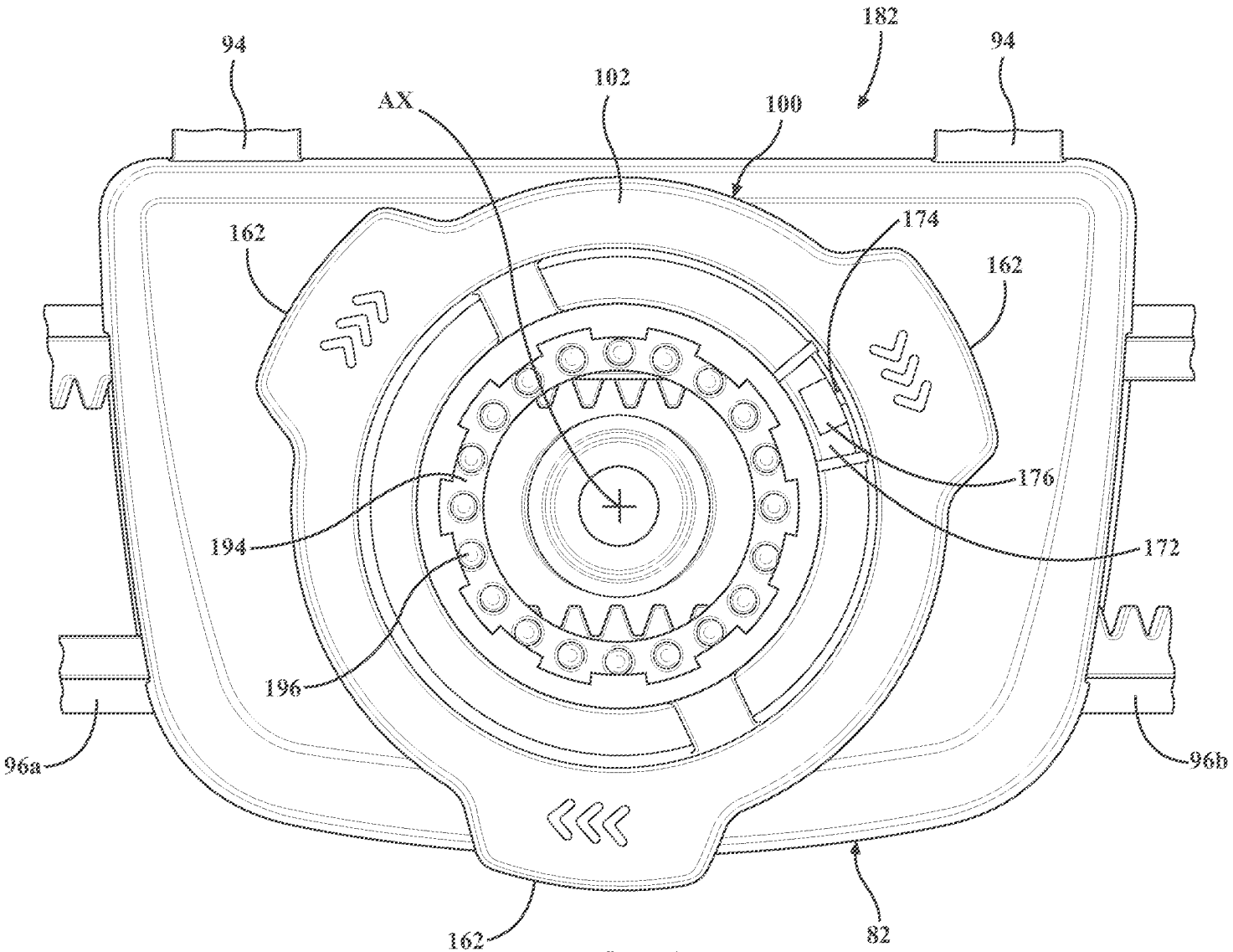
FIG. 15 is another rear elevation view of the headband assembly and the two adjustment assemblies of the surgical helmet assembly with one actuation member removed and the other actuation member in a second orientation.
Figure 16A:
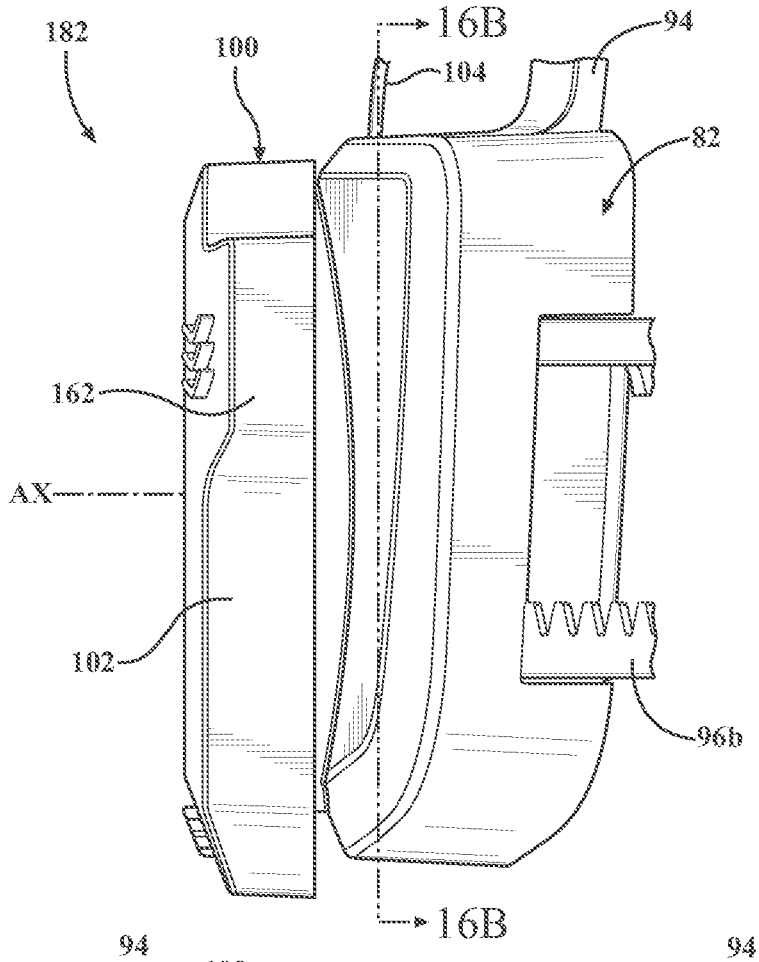
FIG. 16A is side elevation view of the headband assembly and the two adjustment assemblies of the surgical helmet assembly with one actuation member removed and the other actuation member in the second orientation.
Figure 16B:
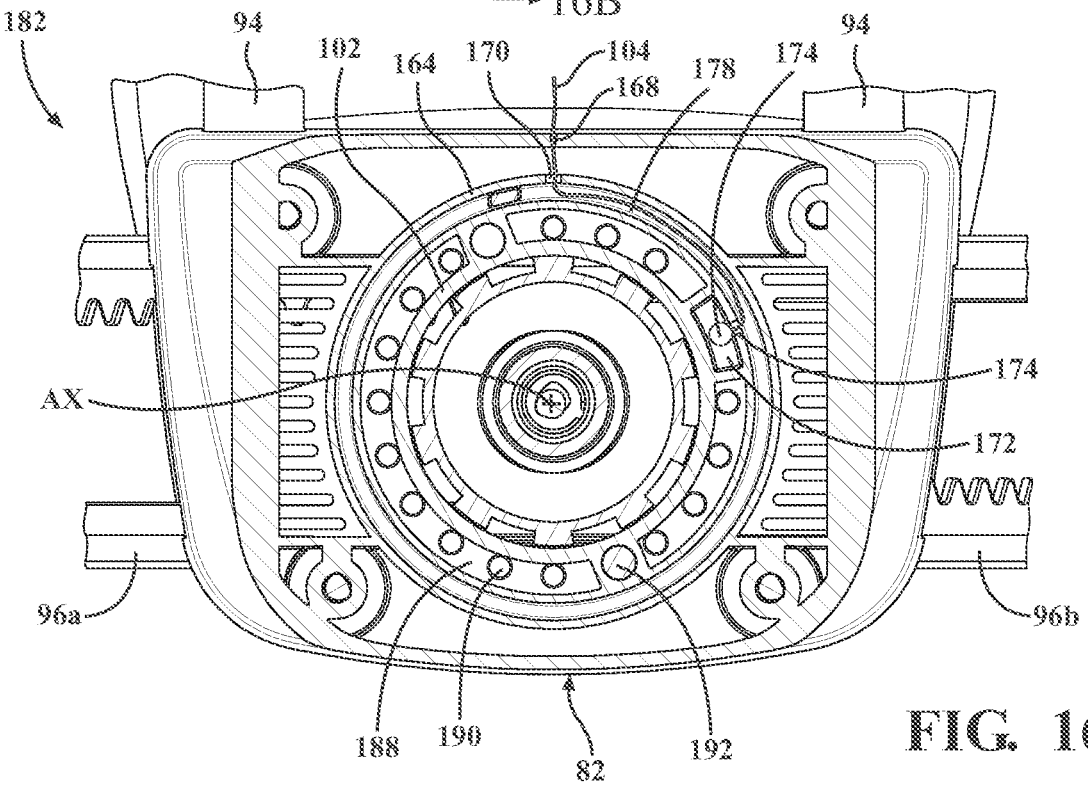
FIG. 16B is a sectional view of the headband assembly and the two adjustment assemblies of the surgical helmet assembly with one actuation member removed and the other actuation member in the second orientation taken along line 16B-16B of FIG. 16A.
Figure 17:
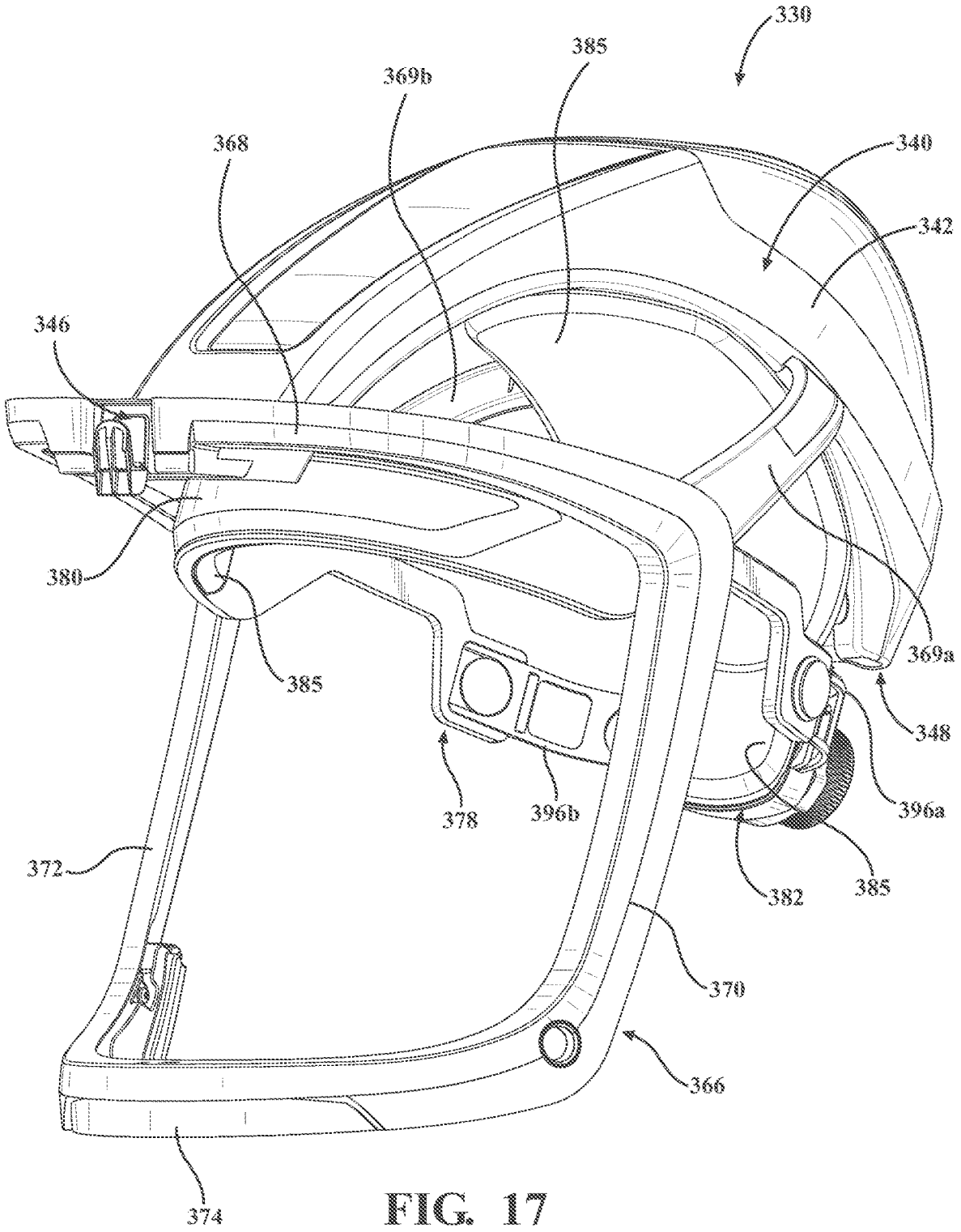
FIG. 17 is a perspective view of another configuration of a surgical helmet assembly.

In an exemplary configuration referenced in FIGS. 14-16B, rotation of the sagittal actuation member 102 from a first orientation 180 shown in FIG. 14 to a second orientation 182 shown in FIGS. 15 and 16 causes the tension element 104 to wind on the winding surface 178. Winding of the tension element 104 on the winding surface 178 results in movement of the tension element 104 relative to the helmet shell 42. Thus, rotation of the sagittal actuation member 102 results in movement of the front support member 80 relative to the helmet shell 42 to the first position 108, the second position 110, and the one or more intermediate positions. For example, the front support member 80 may be in the first position 108 (FIG. 7) when the sagittal actuation member 102 is in the first orientation 180 shown in FIG. 14. When the sagittal actuation member 102 is rotated to the second orientation 182 shown in FIGS. 15 and 16, the tension element 104 winds on the winding surface 178 to pull the second end of the tension element 104 to move the front support member 80 to the second position 110 (FIG. 6). When the sagittal actuation member 102 is rotated back to the first orientation 180 from the second orientation 182, the sagittal actuation member 102 permits the biasing mechanism 114 to pull the tension element 104 and the front support member 80 back toward the first position 108.

Figure 12:
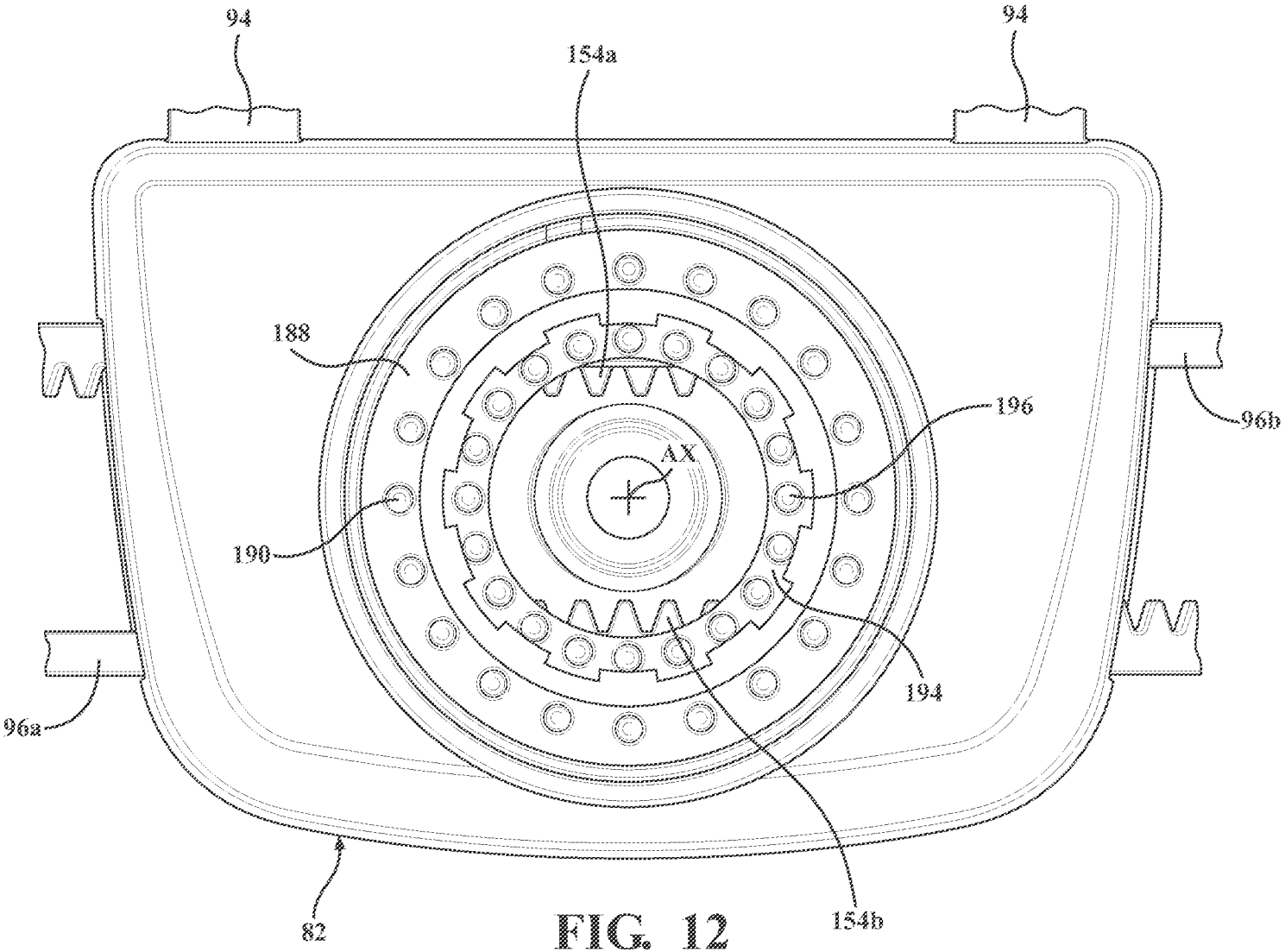
FIG. 12 is another rear elevation view of the headband assembly and the two adjustment assemblies of the surgical helmet assembly with actuation members removed.
Figure 13:
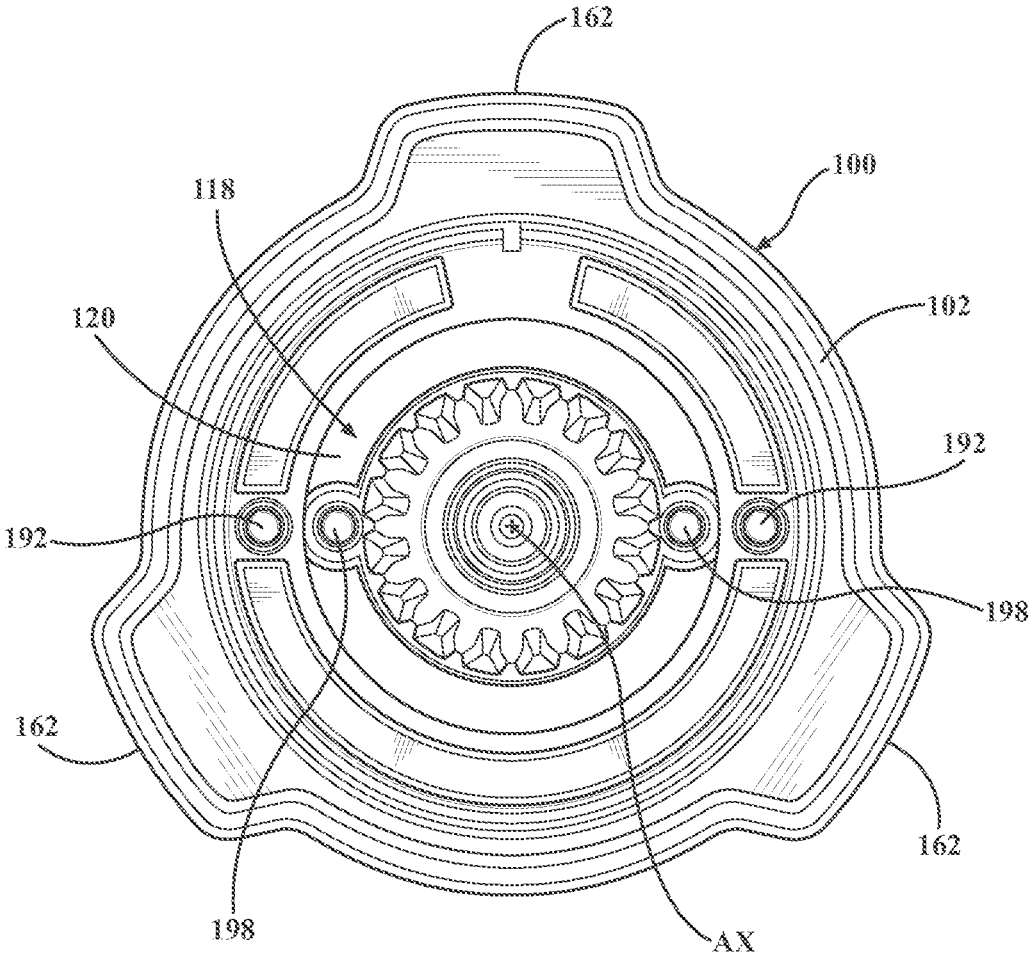
FIG. 13 is another rear elevation view of the actuation members of the two adjustment assemblies.

In order to retain orientations of the sagittal actuation member 102 and the circumferential actuation member 120, biasing mechanisms 184, 186 may be coupled to the sagittal actuation member 102 and the circumferential actuation member 120. Referring to FIGS. 12 and 13, the intermediate portion 126 of the rear support member 82 comprises a sagittal adjustment surface 188 disposed annularly about the actuation axis AX and adjacent the sagittal actuation member 102. The sagittal adjustment surface 188 defines a plurality of detents 190 (i.e. recesses) radially spaced from the actuation axis AX and circumferentially spaced from each other. The sagittal adjustment assembly 100 comprises one or more pins 192 coupled to the sagittal actuation member 102 and configured to revolve about the actuation axis AX in response to rotation of the sagittal actuation member 102. In some configurations, the sagittal actuation member 102 comprises projections extending toward the detents 190 to form the one or more pins 192. In other configurations, the one or more pins 192 are attached to the sagittal actuation member 102. One of the biasing mechanisms 184 is configured to bias the one or more pins 192 into engagement with sagittal adjustment surface 188 to engage the plurality of detents 190 and restrict free rotation of the sagittal actuation member 102 about the actuation axis AX. Similarly, the intermediate portion 126 of the rear support member 82 comprises a circumferential adjustment surface 194 disposed annularly about the actuation axis AX and adjacent the circumferential actuation member 120. The circumferential adjustment surface 194 defines a plurality of detents 196 (i.e. recesses) radially spaced from the actuation axis AX and circumferentially spaced from each other. The circumferential adjustment assembly 118 comprises one or more pins 198 coupled to the circumferential actuation member 120 and configured to revolve about the actuation axis AX in response to rotation of the circumferential actuation member 120. In some configurations, the circumferential actuation member 120 comprises projections extending toward the plurality of detents 196 to form the one or more pins 198. In other configurations, the one or more pins 198 are attached to the circumferential actuation member 120. The other biasing mechanism 186 is configured to bias the one or pins 198 into engagement with circumferential adjustment surface 194 to engage the plurality of detents 196 and restrict free rotation of the circumferential actuation member 120 about the actuation axis AX. The biasing mechanism 114 coupled to the front support member 80 is configured to exert constant force on the tension element 104 to bias the front support member 80 toward the first position 108. This constant force is not sufficient to disengage the one or more pins 198 from at least one of the plurality of detents 196.

Referring to FIGS. 17-21, an alternative configuration of the surgical helmet assembly 330 is illustrated. It should be appreciated that the various configurations of the surgical helmet assembly 330 may include similar elements that may be identified by reference numerals that are incremented by 300. It should be understood that those elements including reference numerals which are incremented by 300 can have the same features as described above.

Figure 18:
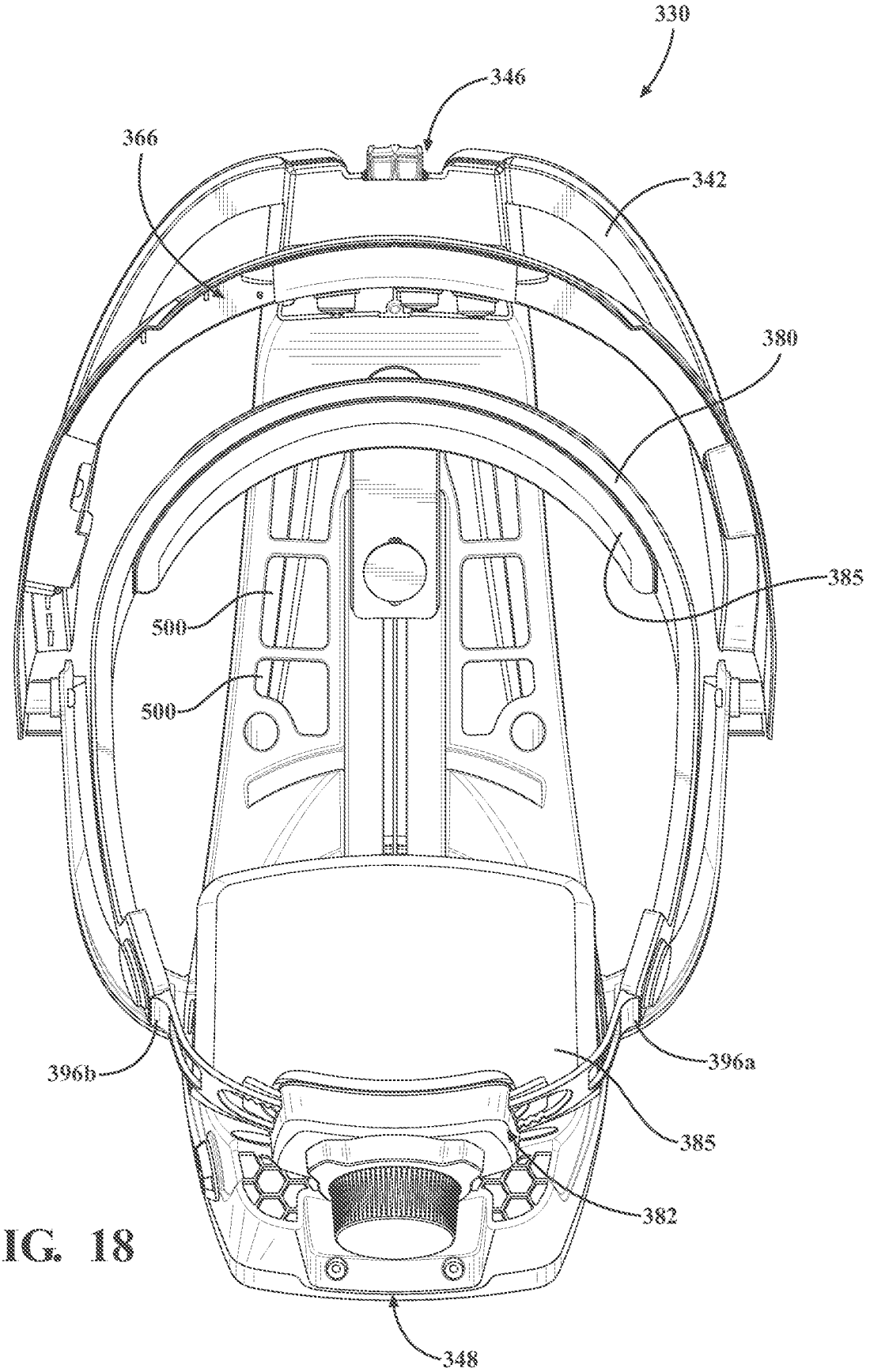
FIG. 18 is a bottom view of the surgical helmet assembly of FIG. 17.

Referring to FIG. 18, the duct 354 of the helmet shell 342 may define a vent 500 disposed between the fan 362 and the first outlet opening 360*a*. The vent 500 may be configured to permit a portion of the air forced through the duct 354 from the fan 362 toward the first outlet opening 360*a* to be expelled from the duct 354 before reaching the first outlet opening 360*a*. In some configurations, the first outlet opening 360*a* directs the air to the lower face of the user during operation. In such configurations, the first outlet opening 360*a* may be referred to as a "lower face nozzle." A plurality of vents 500 are illustrated, however, it is contemplated that a single vent 500 may be employed. The vent 500 optimizes flow characteristics of the air being forced through the duct 354 to the first outlet opening 360*a* by the fan 362 to improve the efficiency of the ventilation sub-assembly 344. More specifically, the vent 500 may reduce the pressure differential between where the air enters the duct 354 from the fan 362 and where the air is expelled through the first outlet opening 360*a*. For this reason, the vent may be referred to as a "pressure relief vent." This reduction in pressure differential permits the motor 364 to operate the fan 362 at a relatively lower speed while maintaining the desired volumetric flow of air out of the first outlet opening 360*a*. Operating the fan 362 at a lower speed permits the ventilation sub-assembly 344 to operate with lower energy consumption.

Another advantage to the vent 500 is a reduction of noise and/or vibrations resulting from operation of the fan 362 at lower speeds. Heightened levels of noise and vibration may introduce distractions to users during use e.g., during surgeries. An increase in fan speed often results in an increase in noise and/or vibrations. By providing the vent 500, the fan 362 may operate at a reduced speed while maintaining the desired volumetric flow of air out of the first outlet opening 360*a*. The reduction in fan speed may produce relatively less noise and/or vibration, which mitigates distractions resulting from operation of the fan 362 to the user during use and improves comfort to the user by providing a quieter environment.

Figure 19:
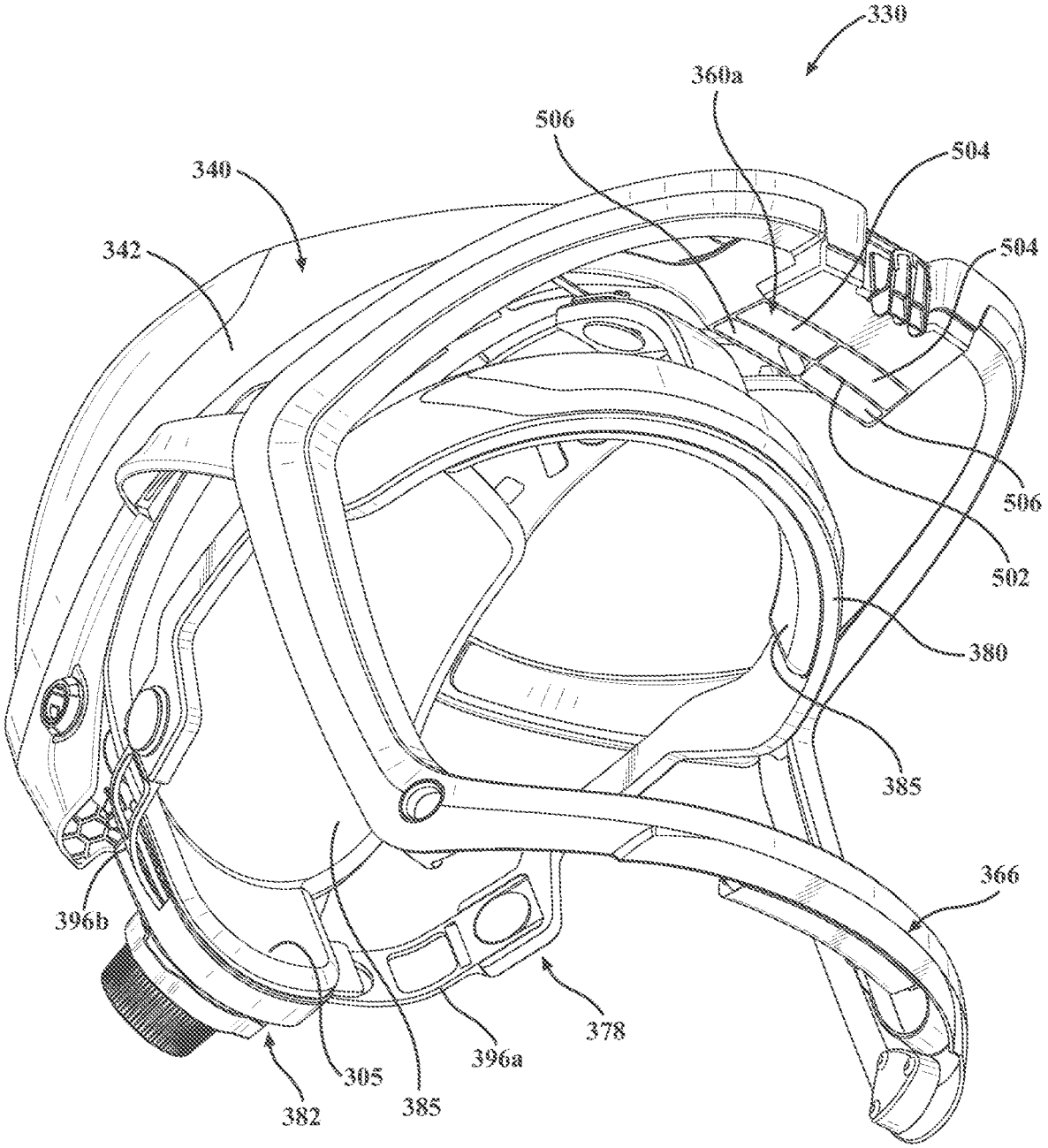
FIG. 19 is another perspective view of the surgical helmet assembly of FIG. 17.

Referring to FIG. 19, the first outlet opening 360*a* of the helmet shell 342 may be positioned below a top portion of the continuous loop of the headband assembly 378 and the fan 362 may be configured to expel air through the first outlet opening 360*a* toward the lower face of the user. The vent 500 may be positioned above the continuous loop of the headband assembly 378 and the fan 362 may be configured to expel air through the vent 500 toward a top of the user's head.

The helmet shell 342 may comprise a flow directing member 502 that separates the first output opening 360*a* into one or more face shield openings 504 and one or more lower face openings 506. The one or more face shield openings 504 may be disposed farther from the front support member 380 than the one or more lower face openings 506. Further, the flow directing member 502 may be oriented such that a portion of the air expelled through the one or more lower face openings 506 is directed toward the lower face of the user.

In some configurations, the front support member 380 consists essentially of, or consists of foam. In other words, the entire front support member 380 may consist of foam. The foam may consist essentially of ethylene-vinyl acetate (EVA) foam. In configurations where the front support member 380 is formed of foam, the front support member 380 may conform more comfortably to the head of the user. With better conformity to the user's head, the front support member 380 may apply pressure more evenly to the head of the user to reduce pressure points on the user's head during sagittal and circumferential adjustment of the helmet shell 342 and the headband assembly 378. In some configurations where the front support member 380 is formed entirely of foam, the pair of straps 396*a*, 396*b*, and the rear support member 382 may be formed of another material e.g., rigid plastic. In this manner, the headband assembly 378 may be formed of different material to benefit certain attributes of the headband assembly 378. For instance, a rigid plastic material may be a beneficial material selection for the pair of straps 396*a*, 396*b* and the rear support member 382 for its rigidity to best support durability and functionality during operation of the circumferential adjustment assembly 418. As mentioned above, a foam material may be a beneficial material selection for the front support member 380 to conform to the head of the user to reduce pressure points during sagittal and circumferential adjustment of the helmet shell 342 and the headband assembly 378 to the head of the user. It is contemplated that a front support member 380 consisting of foam as described above may be used in conjunction with adjustment assemblies different than those described above.

Figure 20:
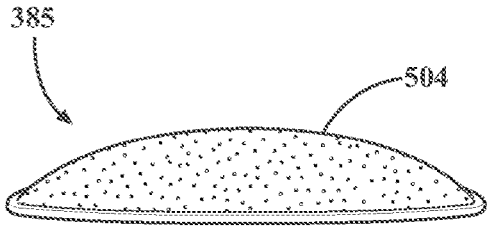
FIG. 20 is an elevation view of a padding of a front support member of the surgical helmet assembly of FIG. 17.
Figure 21:
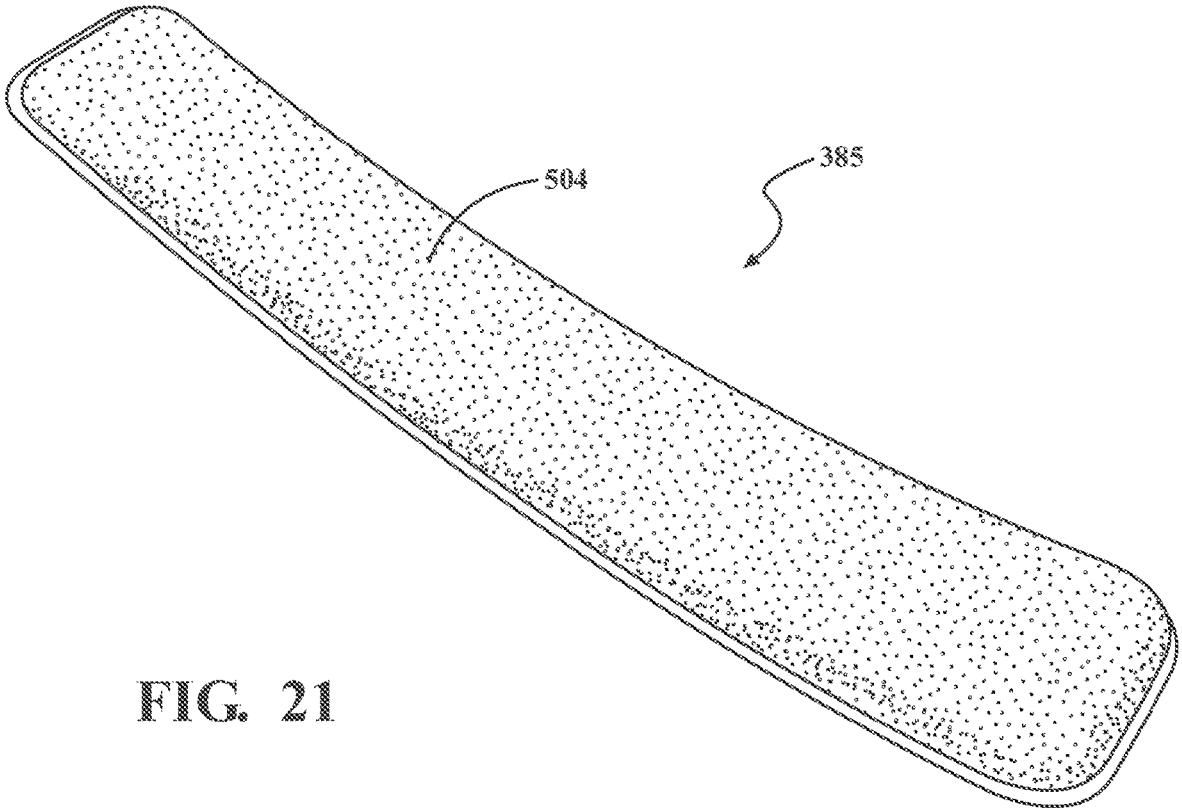
FIG. 21 is a perspective view of the padding of the front support member of the surgical helmet assembly of FIG. 17.

Referring to FIG. 19-21, padding 385 may be coupled to one or more of the front support member 380, the interior surface 356 of the helmet shell 342, and a surface of the rear support member 382 that is configured to face the user when the surgical helmet assembly 330 is worn. The padding 385 is configured to abut the head of the user to provide cushioning to the user to increase comfort when the surgical helmet assembly 330 is worn. The padding 385 may comprise a reticulated foam. The reticulated foam may be formed of one or more of polyether, polyester, another polyurethane material, or another organic polymer. Reticulated foam is advantageous for padding, as it is lighter than conventional foam. The padding 385 may also comprise a wicking fabric 508 that may be disposed over the reticulated foam to abut the head of the user and draw moisture away from the head of the user. The wicking fabric 508 may be formed of one or more materials selected from polyester, polypropylene, wool, spandex, or another material suitable for drawing moisture away from the user upon contact.

It should be noted that in many of the figures described herein, certain components of the surgical helmet assembly 30, 330 have been removed for convenience of description and ease of illustration.

It should also be noted that while the surgical helmet assembly 30, 330 is directed to surgical applications, the surgical helmet assembly 30, 330 could be employed for non-surgical applications such as those applications where ventilation sub-assemblies are not required or where surgical garments are not required.

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The invention is intended to be defined in the independent claims, with specific features laid out in the dependent claims, wherein the subject matter of a claim dependent from one independent claim can also be implemented in connection with another independent claim.

The present disclosure also comprises the following clauses, with specific features laid out in dependent clauses, that may specifically be implemented as described in greater detail with reference to the configurations and drawings above.

I. A surgical helmet assembly for mounting to a head of a user during surgical operations, the surgical helmet assembly comprising:

a frame assembly comprising:

a helmet shell having a first end and a second end, and a fan coupled to the helmet shell for circulating air;

a headband assembly comprising:

a front support member coupled to the helmet shell adjacent the first end of the helmet shell and the front support member configured to abut a forehead of the user, a rear support member coupled to the helmet shell adjacent the second end of the helmet shell and the rear support member configured to abut a rear region of the head of the user, and a strap having a first end movably coupled to the rear support member and a second end coupled to the front support member;

a first adjustment assembly comprising:

a first actuation member rotatably coupled to the rear support member, with the first actuation member rotatable about an actuation axis, and a tension element having a first end operatively connected to the first actuation member and a second end coupled to the front support member, and the tension element being movable relative to the helmet shell in response to rotation of the first actuation member to adjust a sagittal fit of the frame assembly and the headband assembly to the head of the user; and a second adjustment assembly comprising a second actuation member rotatably coupled to the rear support member, with the second actuation member rotatable about the actuation axis such that the first actuation member and the second actuation member are concentric, and with the actuation member operatively coupled to the strap adjacent the first end, the strap being movable relative to the rear support member in response to rotation of the second actuation member to adjust a circumferential fit of the headband assembly to the head of the user.

II. The surgical helmet assembly of clause I, wherein the strap is further defined as a first strap and the headband assembly comprises a second strap coupled to the front support member and the rear support member, and wherein the first and second straps collectively form a pair of straps, with the pair of straps, the front support member, and the rear support member collectively forming a continuous loop to circumferentially surround the head of the user.

III. The surgical helmet assembly of clause II, wherein the second actuation member is arranged to engage at least one strap of the pair of straps, and the at least one strap of the pair of straps being movable relative to the rear support member to adjust a size of a perimeter defined by the continuous loop in response to rotation of the second actuation member.

IV. The surgical helmet assembly of any of clauses I-III, wherein the front support member comprises a base portion configured to abut the forehead of the user and the front support member comprises a leg portion extending from the base portion, with the leg portion coupled to the helmet shell adjacent the first end of the helmet shell and the leg portion coupled to the second end of the tension element.

V. The surgical helmet assembly of clause IV, wherein one of the helmet shell and the leg portion of the front support member comprises a surface defining a slot, with the slot having a first end proximal the first end of the helmet shell and a second end distal to the first end of the helmet shell, and wherein the other of the helmet shell and the leg portion of the front support member comprises a projection, with the slot configured to receive at least a portion of the projection to constrain the relative motion of the front support member to the helmet shell.

VI. The surgical helmet assembly of clause V, wherein the second end of the tension element is coupled to the leg portion of the front support member and the projection is movable within the slot in response to movement of the tension element from rotation of the actuation member.

VII. The surgical helmet assembly of clause VI, wherein the leg portion of the front support member comprises the projection and the frame assembly further comprises a biasing mechanism coupled to the helmet shell and the projection to bias the projection toward the first end of the slot.

VIII. The surgical helmet assembly of clause VII, wherein one of the rear support member and the helmet shell comprises an adjustment surface disposed annularly about the actuation axis and adjacent the first actuation member, with the adjustment surface defining a plurality of detents radially spaced from the actuation axis and circumferentially spaced from each other, and wherein the first adjustment assembly further comprises one or more biasing mechanisms coupled to the first actuation member, with the one or more biasing mechanisms configured to cooperate with the first actuation member to engage the plurality of detents and restrict free rotation of the first actuation member about the actuation axis.

IX. The surgical helmet assembly of any of clauses I-VIII, wherein the helmet shell comprises a tension element guide disposed between the first and second ends of the helmet shell, at least a portion of the tension element being received by the tension element guide of the helmet shell.

X. The surgical helmet assembly of any of clauses I-IX, wherein the first actuation member comprises a surface configured to abut the tension element, with at least a portion of the tension element configured to wind and unwind on the surface of the first actuation member responsive to rotation of the first actuation member.

XI. The surgical helmet assembly of any of clause I-X, wherein the helmet shell comprises one or more coupling features to couple a surgical garment to the helmet shell.

XII. The surgical helmet assembly of clause XI, wherein the one or more coupling features comprises a complementary fastening feature of one of a hook and loop fastener, a magnetic fastener, and a button and snap fastener for coupling to a corresponding complementary fastening feature of a garment.

XIII. The surgical helmet assembly of any of clauses I-XII, wherein the first actuation member extends outwardly from the actuation axis farther than the second actuation member.

XIV. The surgical helmet assembly of clause XIII, wherein the helmet shell comprises a duct, the duct defining an inlet opening and an outlet opening, with the fan configured to draw air into the duct through the inlet opening and expel air out of the duct through the outlet opening.

XV. A surgical helmet assembly for mounting to a head of a user during surgical operations, the surgical helmet assembly comprising:

a frame assembly having a center of mass, the frame assembly comprising:

a helmet shell having a first end and a second end, and a fan coupled to the helmet shell for circulating air;

a headband assembly comprising:

a front support member coupled to the helmet shell adjacent the first end of the helmet shell and the front support member comprising a base portion configured to abut a forehead of the user, and a rear support member coupled to the helmet shell adjacent the second end of the helmet shell and the rear support member configured to abut a rear region of the head of the user; and an adjustment assembly comprising:

an actuation member rotatably coupled to one of the helmet shell and the rear support member, with the actuation member rotatable about an actuation axis, and a tension element having a first end operatively connected to the actuation member and a second end coupled to the front support member, and the tension element being movable relative to the helmet shell in response to rotation of the actuation member;

wherein the front support member is moveable relative to the helmet shell to a first position, a second position, and intermediate positions therebetween in response to movement of the tension element from rotation of the actuation member, and wherein the center of mass of the frame assembly is at a first distance from the base portion of the front support member when the front support member is in the first position and the center of mass of the frame assembly is at a second distance from the base portion of the front support member when the front support member is in the second position, and wherein the first distance is greater than the second distance to accommodate a plurality of head sizes while retaining the center of mass of the frame assembly in close proximity to the head of the user when the front support member moves between the first position, the second position, and the intermediate positions.

XVI. The surgical helmet assembly of clause XV, wherein the adjustment assembly is further defined as a first adjustment assembly and the actuation member is further defined as a first actuation member, and the surgical helmet assembly further comprises a second adjustment assembly coupled to the rear support member and configured to adjust a circumferential fit of the headband assembly to the head of the user.

XVII. The surgical helmet assembly of clause XVI, wherein the headband assembly further comprises a pair of straps coupled to the rear support member and the base portion of the front support member, with the base portion of the front support member, the pair of straps, and the rear support member collectively forming a continuous loop to circumferentially surround the head of the user.

XVIII. The surgical helmet assembly of clause XVII, wherein the second adjustment assembly comprises a second actuation member rotatably coupled to the rear support member, with the second actuation member arranged to engage at least one strap of the pair of straps, and the at least one strap of the pair of straps being movable relative to the rear support member to adjust a size of a perimeter defined by the continuous loop in response to rotation of the second actuation member.

XIX. The surgical helmet assembly of clause XVIII, wherein the first actuation member is coupled to the rear support member, and the second actuation member is configured to rotate about the actuation axis of the first actuation member such that the first actuation member is concentric with the second actuation member.

XX. The surgical helmet assembly of clause XIX, wherein the actuation member of the first adjustment assembly extends outwardly from the actuation axis farther than the actuation member of the second adjustment assembly.

XXI. The surgical helmet assembly of any of clauses XV-XX, wherein the front support member comprises a leg portion extending from the base portion, with the leg portion coupled to the helmet shell adjacent the first end of the helmet shell.

XXII. The surgical helmet assembly of clause XXI, wherein one of the helmet shell and the leg portion of the front support member comprises a surface defining a slot, with the slot having a first end proximal the first end of the helmet shell and a second end distal to the first end of the helmet shell, and wherein the other of the helmet shell and the leg portion of the front support member comprises a projection, with the slot configured to receive at least a portion of the projection to constrain the relative motion of the front support member to the helmet shell.

XXIII. The surgical helmet assembly of clause XXII, wherein the projection is movable within the slot to be adjacent the first end of the slot when the front support member is in the first position and the projection is movable within the slot to be adjacent the second end of the slot when the front support member is in the second position.

XXIV. The surgical helmet assembly of clause XXIII, wherein the second end of the tension element is coupled to the leg portion of the front support member and the projection is movable within the slot in response to movement of the tension element from rotation of the actuation member.

XXV. The surgical helmet assembly of clause XXIV, wherein the frame assembly further comprises a biasing mechanism coupled to the helmet shell and the front support member to bias the front support member toward the first position.

XXVI. The surgical helmet assembly of clause XXV, wherein the leg portion of the front support member comprises the projection and the biasing mechanism is coupled to the projection to bias the projection toward the first end of the slot.

XXVII. The surgical helmet assembly of any of clauses XXIV-XXVI, wherein one of the rear support member and the helmet shell comprises an adjustment surface disposed annularly about the actuation axis and adjacent the actuation member, with the adjustment surface defining a plurality of detents radially spaced from the actuation axis and circumferentially spaced from each other, and wherein the adjustment assembly further comprises one or more biasing mechanisms coupled to the actuation member, with the one or more biasing mechanisms configured to cooperate with the actuation member to engage the plurality of detents and restrict free rotation of the actuation member about the actuation axis.

XXVIII. The surgical helmet assembly of clause XXVII, wherein the adjustment assembly comprises one or more pins coupled to the actuation member and configured to revolve about the actuation axis in response to rotation of the actuation member, and wherein the biasing mechanism is configured to bias the one or pins into engagement with the plurality of detents.

XXIX. The surgical helmet assembly of clause XXVIII, wherein the biasing mechanism coupled to the front support member is configured to exert a first force on the tension element to bias the front support member toward the first position, and a second force is required to disengage the one or more pins from engaging at least one of the plurality of detents, wherein the second force is greater than the first force.

XXX. The surgical helmet assembly of any of clauses XV-XXIX, wherein the helmet shell comprises a tension element guide disposed between the first and second ends of the helmet shell, at least a portion of the tension element being received by the tension element guide of the helmet shell.

XXXI. The surgical helmet assembly of any of clauses XV-XXX, wherein the actuation member comprises a surface configured to abut the tension element, with at least a portion of the tension element configured to wind and unwind on the surface of the actuation member responsive to rotation of the actuation member.

XXXII. The surgical helmet assembly of any of clauses XV-XXXI, wherein the helmet shell comprises one or more coupling features to couple a surgical garment to the helmet shell.

XXXIII. The surgical helmet assembly of clause XXXII, wherein the one or more coupling features comprises a complementary fastening feature of one of a hook and loop fastener, a magnetic fastener, and a button and snap fastener for coupling to a corresponding complementary fastening feature of a garment.

XXXIV. The surgical helmet assembly of any of clauses XV-XXXIII, wherein the helmet shell comprises a duct, the duct defining an inlet opening and an outlet opening, with the fan configured to draw air into the duct through the inlet opening and expel air out of the duct through the outlet opening.

XXXV. A surgical helmet assembly for mounting to a head of a user during surgical operations, the surgical helmet assembly comprising:

a frame assembly comprising:

a helmet shell having a first end and a second end, and the helmet shell having an interior surface, and a fan coupled to the helmet shell for circulating air;

a headband assembly forming a continuous loop configured to circumferentially surround the head of the user, the headband assembly comprising:

a front support member coupled to the helmet shell adjacent the first end of the helmet shell and the front support member comprising a base portion configured to abut a forehead of the user, and a rear support member coupled to the helmet shell adjacent the second end of the helmet shell and the rear support member configured to abut a rear region of the head of the user; and an adjustment assembly comprising:

an actuation member rotatably coupled to one of the helmet shell and the rear support member, with the actuation member rotatable about an actuation axis, and a tension element having a first end operatively connected to the actuation member and a second end coupled to the front support member, with the tension element being movable relative to the helmet shell in response to rotation of the actuation member;

wherein the front support member is moveable relative to the helmet shell in response to movement of the tension element from rotation of the actuation member, and wherein the front support member is movable to a first position defining a first head receiving volume bounded by the continuous loop and the interior surface of the helmet shell, and the front support member is movable relative to the helmet shell to a second position defining a second head receiving volume bounded by the continuous loop and the interior surface of the helmet shell, and wherein the first head receiving volume is larger than the second head receiving volume to accommodate a plurality of head sizes while retaining the interior surface of the helmet shell in close proximity to the head of the user when the front support member moves between the first position, the second position, and the intermediate positions.

XXXVI. The surgical helmet assembly of clause XXXV, wherein the adjustment assembly is further defined as a first adjustment assembly and the actuation member is further defined as a first actuation member, and the surgical helmet assembly further comprises a second adjustment assembly coupled to the rear support member and configured to adjust a circumferential fit of the headband assembly to the head of the user.

XXXVII. The surgical helmet assembly of clause XXXVI, wherein the headband assembly further comprises a pair of straps coupled to the rear support member and the base portion of the front support member, with the base portion of the front support member, the pair of straps, and the rear support member collectively forming the continuous loop to circumferentially surround the head of the user.

XXXVIII. The surgical helmet assembly of clause XXXVII, wherein the second adjustment assembly comprises a second actuation member rotatably coupled to the rear support member, with the second actuation member arranged to engage at least one strap of the pair of straps, and the at least one strap of the pair of straps being moveable relative to the rear support member to adjust a size of a perimeter defined by the continuous loop in response to rotation of the second actuation member.

XXXIX. The surgical helmet assembly of clause XXXVIII, wherein the first actuation member is coupled to the rear support member, and the second actuation member is rotatable about the actuation axis of the first actuation member such that the first actuation member is concentric with the second actuation member.

XL. The surgical helmet assembly of clause XXXIX, wherein the actuation member of the first adjustment assembly extends outwardly from the actuation axis farther than the actuation member of the second adjustment assembly.

XLI. The surgical helmet assembly of any of clauses XXXV-XL, wherein the front support member comprises a leg portion extending from the base portion, with the leg portion coupled to the helmet shell adjacent the first end of the helmet shell.

XLII. The surgical helmet assembly of clause XLI, wherein one of the helmet shell and the leg portion of the front support member comprises a surface defining a slot, with the slot having a first end proximal the first end of the helmet shell and a second end distal to the first end of the helmet shell, and wherein the other of the helmet shell and the leg portion of the front support member comprises a projection, with the slot configured to receive at least a portion of the projection to constrain the relative motion of the front support member to the helmet shell.

XLIII. The surgical helmet assembly of clause XLII, wherein the projection is movable within the slot to be adjacent the first end of the slot when the front support member is in the first position and the projection is movable within the slot to be adjacent the second end of the slot when the front support member is in the second position.

XLIV. The surgical helmet assembly of clause XLIII, wherein the second end of the tension element is coupled to the leg portion of the front support member and the projection is movable within the slot in response to movement of the tension element from rotation of the actuation member.

XLV. The surgical helmet assembly of clause XLIV, wherein the frame assembly further comprises a biasing mechanism coupled to the helmet shell and the front support member to bias the front support member toward the first position.

XLVI. The surgical helmet assembly of clause XLV, wherein the leg portion of the front support member comprises the projection and the biasing mechanism is coupled to the projection to bias the projection toward the first end of the slot.

XLVII. The surgical helmet assembly of any of clauses XLIV-XLVI, wherein one of the rear support member and the helmet shell comprises an adjustment surface disposed annularly about the actuation axis and adjacent the actuation member, with the adjustment surface defining a plurality of detents radially spaced from the actuation axis and circumferentially spaced from each other, and wherein the adjustment assembly further comprises one or more biasing mechanisms coupled to the actuation member, with the one or more biasing mechanisms configured to cooperate with the actuation member to engage the plurality of detents and restrict free rotation of the actuation member about the actuation axis.

XLVIII. The surgical helmet assembly of clause XLVII, wherein the adjustment assembly comprises one or more pins coupled to the actuation member and configured to revolve about the actuation axis in response to rotation of the actuation member, and wherein the biasing mechanism is configured to bias the one or pins into engagement with the plurality of detents.

XLIX. The surgical helmet assembly of clause XLVIII, wherein the biasing mechanism coupled to the front support member is configured to exert a first force on the tension element to bias the front support member toward the first position, and a second force is required to disengage the one or more pins from engaging at least one of the plurality of detents, wherein the second force is greater than the first force.

L. The surgical helmet assembly of any of clauses XXXV-XLIX, wherein the helmet shell comprises a tension element guide disposed between the first and second ends of the helmet shell, at least a portion of the tension element being received by the tension element guide of the helmet shell.

LI. The surgical helmet assembly of any of clauses XXXV-L, wherein the actuation member comprises a surface configured to abut the tension element, with at least a portion of the tension element configured to wind and unwind on the surface of the actuation member responsive to rotation of the actuation member.

LII. The surgical helmet assembly of any of clauses XXXV-LI, wherein the helmet shell comprises one or more coupling features to couple a surgical garment to the helmet shell.

LIII. The surgical helmet assembly of clause LII, wherein the one or more coupling features comprises a complementary fastening feature of one of a hook and loop fastener, a magnetic fastener, and a button and snap fastener for coupling to a corresponding complementary fastening feature of a garment.

LIV. The surgical helmet assembly of any of clauses XXXV-LIII, wherein the helmet shell comprises a duct, the duct defining an inlet opening and an outlet opening, with the fan configured to draw air into the duct through the inlet opening and expel air out of the duct through the outlet opening.

LV. A surgical helmet assembly for mounting to a head of a user during surgical operations, the surgical helmet assembly comprising:

a frame assembly comprising:

a helmet shell having a first end and a second end, the helmet shell comprising a duct, the duct defining an inlet opening and an outlet opening, and a fan coupled to the helmet shell, the fan configured to draw air into the duct through the inlet opening and expel air out of the duct through the outlet opening;

a headband assembly comprising:

a front support member slidably coupled to the helmet shell adjacent the first end of the helmet shell and the front support member configured to abut a forehead of the user, and a rear support member coupled to the helmet shell adjacent the second end of the helmet shell and the rear support member configured to abut a rear region of the head of the user; and an adjustment assembly comprising:

an actuation member rotatably coupled to one of the helmet shell and the rear support member, with the actuation member rotatable about an actuation axis, and a tension element having a first end operatively connected to the actuation member and a second end coupled to the front support member, and the tension element being movable relative to the helmet shell in response to rotation of the actuation member;

wherein the second end of the tension element is moveable with the front support member relative to the helmet shell and the actuation member in response to rotation of the actuation member to adjust a sagittal fit of the frame assembly and the headband assembly to the head of the user.

LVI. The surgical helmet assembly of clause LV, wherein the adjustment assembly is further defined as a first adjustment assembly and the actuation member is further defined as a first actuation member, and the surgical helmet assembly further comprises a second adjustment assembly coupled to the rear support member and configured to adjust a circumferential fit of the headband assembly to the head of the user.

LVII. The surgical helmet assembly of clause LVI, wherein the front support member comprises a base portion configured to abut the forehead of the user and wherein the headband assembly further comprises a pair of straps coupled to the rear support member and the base portion of the front support member, with the base portion of the front support member, the pair of straps, and the rear support member collectively forming a continuous loop to circumferentially surround the head of the user.

LVIII. The surgical helmet assembly of clause LVII, wherein the second adjustment assembly comprises a second actuation member rotatably coupled to the rear support member, with the second actuation member configured to engage at least one strap of the pair of straps, and the at least one strap of the pair of straps being movable relative to the rear support member to adjust a size of a perimeter defined by the continuous loop in response to rotation of the second actuation member.

LIX. The surgical helmet assembly of clause LVIII, wherein the first actuation member is coupled to the rear support member, and the second actuation member is rotatable about the actuation axis of the first actuation member such that the first actuation member is concentric with the second actuation member.

LX. The surgical helmet assembly of clause LIX, wherein the actuation member of the first adjustment assembly extends outwardly from the actuation axis farther than the actuation member of the second adjustment assembly.

LXI. The surgical helmet assembly of any of clauses LV-LX, wherein the front support member comprises a base portion configured to abut the forehead of the user and the front support member comprises a leg portion extending from the base portion, with the leg portion coupled to the helmet shell adjacent the first end of the helmet shell and the leg portion coupled to the second end of the tension element.

LXII. The surgical helmet assembly of clause LXI, wherein one of the helmet shell and the leg portion of the front support member comprises a surface defining a slot, with the slot having a first end proximal the first end of the helmet shell and a second end distal to the first end of the helmet shell, and wherein the other of the helmet shell and the leg portion of the front support member comprises a projection, with the slot configured to receive at least a portion of the projection to constrain the relative motion of the front support member to the helmet shell.

LXIII. The surgical helmet assembly of clause LXII, wherein the second end of the tension element is coupled to the leg portion of the front support member and the projection is movable within the slot in response to movement of the tension element from rotation of the actuation member.

LXIV. The surgical helmet assembly of clause LXIII, wherein the leg portion of the front support member comprises the projection and the frame assembly further comprises a biasing mechanism coupled to the helmet shell and the projection to bias the projection toward the first end of the slot.

LXV. The surgical helmet assembly of any of clauses LV-LXIV, wherein the helmet shell comprises a tension element guide disposed between the first and second ends of the helmet shell, at least a portion of the tension element being received by the tension element guide of the helmet shell.

LXVI. The surgical helmet assembly of any of clauses LV-LXV, wherein the actuation member comprises a surface configured to abut the tension element, with at least a portion of the tension element configured to wind and unwind on the surface of the actuation member responsive to rotation of the actuation member.

LXVII. The surgical helmet assembly of any of clauses LV-LXVI, wherein the helmet shell comprises one or more coupling features to couple a surgical garment to the helmet shell.

LXVIII. The surgical helmet assembly of clause LXVII, wherein the one or more coupling features comprises a complementary fastening feature of one of a hook and loop fastener, a magnetic fastener, and a button and snap fastener for coupling to a corresponding complementary fastening feature of a garment.

LXIX. A surgical helmet assembly for mounting to a head of a user during surgical operations, the surgical helmet assembly comprising:

a frame assembly comprising:

a helmet shell having a first end and a second end, the helmet shell comprising a duct, the duct defining an inlet opening, an outlet opening, and a vent, with the outlet opening disposed adjacent the first end of the helmet shell and the vent disposed between the outlet opening and the second end of the helmet shell, and a fan coupled to the helmet shell, the fan configured to draw air into the duct through the inlet opening and expel air out of the duct through the outlet opening and the vent; and a headband assembly forming a continuous loop configured to circumferentially surround the head of the user, the headband assembly comprising:

a front support member coupled to the helmet shell adjacent the first end of the helmet shell, the front support member configured to abut a forehead of the user, and a rear support member coupled to the helmet shell adjacent the second end of the helmet shell, the rear support member configured to abut a rear region of the head of the user;

wherein the outlet opening of the helmet shell is positioned below a top portion of the continuous loop and the fan is configured to expel air through the outlet opening toward the face of the user, and wherein the vent of the helmet shell is positioned above the continuous loop of the headband assembly and the fan is configured to expel air through the vent toward a top of the user's head.

LXX. The surgical helmet assembly of clause LXIX, wherein the outlet opening is further defined as a first outlet opening and the duct of the helmet shell defines a second outlet opening disposed adjacent the second end of the helmet shell, with the vent disposed between the first and second outlet openings, and wherein the fan is configured to expel air out of the second outlet opening toward the back of the head and neck of the user.

LXXI. The surgical helmet assembly of any of clauses LXIX-LXX, wherein the helmet shell defines a top portion and a bottom portion, with the top and bottom portions defining the duct, and with the bottom portion having an interior surface facing away from the duct and toward the headband assembly, and wherein the bottom portion defines the vent to permit the expulsion of air toward the top of the user's head.

LXXII. A surgical helmet assembly for mounting to a head of a user during surgical operations, the surgical helmet assembly comprising:

a frame assembly comprising:

a helmet shell having a first end and a second end, and a fan coupled to the helmet shell for circulating air; and a headband assembly forming a continuous loop configured to circumferentially surround the head of the user, the headband assembly comprising:

a front support member coupled to the helmet shell adjacent the first end of the helmet shell and the front support member configured to abut a forehead of the user, a rear support member coupled to the helmet shell adjacent the second end of the helmet shell and the rear support member configured to abut a rear region of the head of the user, and a pair of straps coupled to the rear support member and the front support member, with the front support member, the pair of straps, and the rear support member collectively forming the continuous loop;

wherein the front support member extends between the pair of straps and consists essentially of foam.

LXXIII. The surgical helmet assembly of clause LXXII, wherein the front support member consists essentially of ethylene-vinyl acetate foam.

LXXIV. The surgical helmet assembly of any of clauses LXXII-LXXIII, wherein the front support member comprises a base portion extending between and coupled to the pair of straps, and wherein the front support member comprises a leg portion extending from the base portion to couple the front support member to the helmet shell.

LXXV. The surgical helmet assembly of any of clauses LXXII-LXXIV, further comprising padding coupled to the front support member and configured to abut the forehead of the user.

LXXVI. The surgical helmet assembly of clause LXXV, wherein the padding comprises reticulated foam.

LXXVII. The surgical helmet assembly of any of clauses LXXV-LXXVI, wherein the padding comprises a wicking material configured to abut the forehead of the user.

LXXVIII. A surgical helmet assembly for mounting to a head of a user during surgical operations, the surgical helmet assembly comprising:

a frame assembly comprising:

a helmet shell having a first end and a second end, and a fan coupled to the helmet shell for circulating air; and a headband assembly forming a continuous loop configured to circumferentially surround the head of the user, the headband assembly comprising:

a front support member coupled to the helmet shell adjacent the first end of the helmet shell and the front support member configured to abut a forehead of the user, a rear support member coupled to the helmet shell adjacent the second end of the helmet shell and the rear support member configured to abut a rear region of the head of the user, and a pair of straps coupled to the rear support member and the front support member, with the front support member, the pair of straps, and the rear support member collectively forming the continuous loop;

wherein the front support member is formed from a first material, the rear support member is formed from a second material, and the pair of straps are formed from a third material, with the second and third materials being different from the first material.

LXXIX. The surgical helmet assembly of clause LXXVIII, further comprising an adjustment assembly coupled to the rear support member, the adjustment assembly configured to adjust a circumferential fit of the headband assembly to the head of the user.

LXXX. The surgical helmet assembly of clause LXXIX, wherein the adjustment assembly comprises an actuation member rotatably coupled to the rear support member, with the actuation member arranged to engage at least one strap of the pair of straps, and the at least one strap of the pair of straps being movable relative to the rear support member to adjust a size of a perimeter defined by the continuous loop in response to rotation of the actuation member.

LXXXI. The surgical helmet assembly of clause LXXX, wherein the engagement between the actuation member and the at least one strap of the pair of straps is a rack and pinion engagement, with the actuation member comprising a pinion having pinion teeth and the at least one strap of the pair of straps comprises a rack having rack teeth to engage the pinion teeth of the actuation member.

LXXXII. The surgical helmet assembly of any of clauses LXXVIII-LXXXI, wherein the first material consists essentially of foam.

LXXXIII. The surgical helmet assembly of clause LXXXII, wherein the first material consists essentially of ethylene-vinyl acetate foam.

LXXXIV. The surgical helmet assembly of any of clauses LXXVIII-LXXXIII, further comprising padding coupled to the front support member and configured to abut the forehead of the user.

LXXXV. The surgical helmet assembly of clause LXXXIV, wherein the padding comprises reticulated foam.

LXXXVI. The surgical helmet assembly of any of clauses LXXXIV-LXXXV, wherein the padding comprises a wicking material configured to abut the forehead of the user.

LXXXVII. A surgical helmet assembly for mounting to a head of a user during surgical operations, the surgical helmet assembly comprising:

a frame assembly comprising:

a helmet shell having a first end and a second end, and a fan coupled to the helmet shell for circulating air;

a headband assembly comprising:

a front support member coupled to the helmet shell adjacent the first end of the helmet shell and the front support member configured to abut a forehead of the user, and a rear support member coupled to the helmet shell adjacent the second end of the helmet shell and the rear support member configured to abut a rear region of the head of the user;

a first actuation member rotatably coupled to the rear support member, with the first actuation member rotatable about an actuation axis to adjust a sagittal fit of the frame assembly and the headband assembly to the head of the user; and a second actuation member rotatably coupled to the rear support member, with the second actuation member rotatable about the actuation axis to adjust a circumferential fit of the headband assembly to the head of the user, with the first actuation member and the second actuation member being concentric.

LXXXVIII. The surgical helmet assembly of clause LXXXVII, wherein the first actuation member extends outwardly from the actuation axis farther than the second actuation member.

LXXXIX. The surgical helmet assembly of any of clauses LXXXVII-LXXXVIII, wherein the helmet shell comprises a duct, the duct defining an inlet opening and an outlet opening, with the fan configured to draw air into the duct through the inlet opening and expel air out of the duct through the outlet opening.

XC. A surgical helmet assembly configured to mount to a head of a user during surgical operations, the surgical helmet assembly comprising:

a frame assembly comprising:

a helmet shell having a first end and a second end, the helmet shell having a duct, the duct defining an inlet opening, a lower face nozzle, and a pressure relief vent, with the lower face nozzle disposed adjacent the first end of the helmet shell and the pressure relief vent disposed between the lower face nozzle and the second end of the helmet shell, and a ventilation sub-assembly including a fan coupled to the helmet shell, the fan configured to:

i) draw air into the duct through the inlet opening, ii) force air drawn into the duct toward the lower face nozzle, and iii) expel air out of the duct through the lower face nozzle and the pressure relief vent; and a headband assembly comprising a front support member and a rear support member for abutting the head of the user and coupling the frame assembly to the head of the user;

wherein the lower face nozzle of the duct is positioned such that the fan is configured to expel air through the lower face nozzle toward the lower face of the user, and wherein the pressure relief vent of the duct is positioned between the lower face nozzle and the fan such that the fan is configured to expel air through the pressure relief vent while air is being forced through the duct to the lower face nozzle to optimize flow characteristics of the air in the duct to increase efficiency of the ventilation sub-assembly.

What is claimed is:

1. A surgical helmet assembly for mounting to a head of a user during surgical operations, the surgical helmet assembly comprising:

a frame assembly having a center of mass, the frame assembly comprising:

a helmet shell having a first end and a second end, and a fan coupled to the helmet shell for circulating air;

a headband assembly comprising:

a front support member coupled to the helmet shell adjacent the first end of the helmet shell and the front support member comprising a base portion configured to abut a forehead of the user, and a rear support member coupled to the helmet shell adjacent the second end of the helmet shell and the rear support member configured to abut a rear region of the head of the user; and an adjustment assembly comprising:

an actuation member rotatably coupled to one of the helmet shell and the rear support member, with the actuation member rotatable about an actuation axis, and a tension element having a first end operatively connected to the actuation member and a second end coupled to the front support member, and the tension element being movable relative to the helmet shell in response to rotation of the actuation member;

wherein the front support member is moveable relative to the helmet shell to a first position, a second position, and intermediate positions therebetween in response to movement of the tension element from rotation of the actuation member, and wherein the center of mass of the frame assembly is at a first distance from the base portion of the front support member when the front support member is in the first position and the center of mass of the frame assembly is at a second distance from the base portion of the front support member when the front support member is in the second position, and wherein the first distance is greater than the second distance to accommodate a plurality of head sizes while retaining the center of mass of the frame assembly in close proximity to the head of the user when the front support member moves between the first position, the second position, and the intermediate positions.

2. The surgical helmet assembly of claim 1, wherein the adjustment assembly is further defined as a first adjustment assembly and the actuation member is further defined as a first actuation member, and the surgical helmet assembly further comprises a second adjustment assembly coupled to the rear support member and configured to adjust a circumferential fit of the headband assembly to the head of the user.

3. The surgical helmet assembly of claim 2, wherein the headband assembly further comprises a pair of straps coupled to the rear support member and the base portion of the front support member, with the base portion of the front support member, the pair of straps, and the rear support member collectively forming a continuous loop to circumferentially surround the head of the user.

4. The surgical helmet assembly of claim 3, wherein the second adjustment assembly comprises a second actuation member rotatably coupled to the rear support member, with the second actuation member arranged to engage at least one strap of the pair of straps, and the at least one strap of the pair of straps being movable relative to the rear support member to adjust a size of a perimeter defined by the continuous loop in response to rotation of the second actuation member.

5. The surgical helmet assembly of claim 4, wherein the first actuation member is coupled to the rear support member, and the second actuation member is configured to rotate about the actuation axis of the first actuation member such that the first actuation member is concentric with the second actuation member; and wherein the actuation member of the first adjustment assembly extends outwardly from the actuation axis farther than the actuation member of the second adjustment assembly.

6. The surgical helmet assembly of claim 1, wherein the front support member comprises a leg portion extending from the base portion, with the leg portion coupled to the helmet shell adjacent the first end of the helmet shell.

7. The surgical helmet assembly of claim 6, wherein one of the helmet shell and the leg portion of the front support member comprises a surface defining a slot, with the slot having a first end proximal the first end of the helmet shell and a second end distal to the first end of the helmet shell, and wherein the other of the helmet shell and the leg portion of the front support member comprises a projection, with the slot configured to receive at least a portion of the projection to constrain the relative motion of the front support member to the helmet shell.

8. The surgical helmet assembly of claim 7, wherein the projection is movable within the slot to be adjacent the first end of the slot when the front support member is in the first position and the projection is movable within the slot to be adjacent the second end of the slot when the front support member is in the second position.

9. The surgical helmet assembly of claim 8, wherein the second end of the tension element is coupled to the leg portion of the front support member and the projection is movable within the slot in response to movement of the tension element from rotation of the actuation member.

10. The surgical helmet assembly of claim 9, wherein the frame assembly further comprises a biasing mechanism coupled to the helmet shell and the front support member to bias the front support member toward the first position; and wherein the leg portion of the front support member comprises the projection and the biasing mechanism is coupled to the projection to bias the projection toward the first end of the slot.

11. The surgical helmet assembly of claim 10, wherein one of the rear support member and the helmet shell comprises an adjustment surface disposed annularly about the actuation axis and adjacent the actuation member, with the adjustment surface defining a plurality of detents radially spaced from the actuation axis and circumferentially spaced from each other, and wherein the adjustment assembly further comprises one or more biasing mechanisms coupled to the actuation member, with the one or more biasing mechanisms configured to cooperate with the actuation member to engage the plurality of detents and restrict free rotation of the actuation member about the actuation axis.

12. The surgical helmet assembly of claim 11, wherein the adjustment assembly comprises one or more pins coupled to the actuation member and configured to revolve about the actuation axis in response to rotation of the actuation member, and wherein the one or more biasing mechanisms coupled to the actuation member are configured to bias the one or more pins into engagement with the plurality of detents.

13. The surgical helmet assembly of claim 12, wherein the biasing mechanism coupled to the helmet shell and the front support member is configured to exert a first force on the tension element to bias the front support member toward the first position, and a second force is required to disengage the one or more pins from engaging at least one of the plurality of detents, wherein the second force is greater than the first force.

14. The surgical helmet assembly of claim 1, wherein the helmet shell comprises a tension element guide disposed between the first and second ends of the helmet shell, at least a portion of the tension element being received by the tension element guide of the helmet shell.

15. The surgical helmet assembly of any of claim 1, wherein the actuation member comprises a surface configured to abut the tension element, with at least a portion of the tension element configured to wind and unwind on the surface of the actuation member responsive to rotation of the actuation member.

16. The surgical helmet assembly of claim 1, wherein the helmet shell comprises one or more coupling features configured to removably couple a surgical garment to the helmet shell.

17. The surgical helmet assembly of claim 16, wherein the one or more coupling features comprises one of a hook and loop fastener, a magnetic fastener, and a button and snap fastener for coupling to a corresponding complementary fastening feature of the surgical garment.

18. The surgical helmet assembly of claim 1, wherein the helmet shell comprises a duct, the duct defining an inlet opening and an outlet opening, with the fan configured to draw air into the duct through the inlet opening and expel air out of the duct through the outlet opening.

19. A surgical helmet assembly for mounting to a head of a user during surgical operations, the surgical helmet assembly comprising:

a helmet shell configured to be disposed at least partially above the head of the user; and a fan coupled to the helmet shell for circulating air;

a headband assembly coupled to the helmet shell, the headband assembly comprising:

a front support member coupled to the helmet shell and comprising a base portion configured to abut a forehead of the user; and a rear support member coupled to the helmet shell opposite the front support member and configured to abut a rear region of the head of the user; and an adjustment assembly comprising:

an adjustment mechanism coupled to one of the helmet shell or the rear support member; and a tension element extending between the adjustment mechanism and a second end coupled to the front support member, and the tension element being movable relative to the helmet shell in response to actuation of the adjustment mechanism;

wherein the front support member is moveable relative to the helmet shell to a first position, a second position, and intermediate positions therebetween in response to actuation of the adjustment mechanism, and wherein the center of mass of the helmet shell is at a first distance from the base portion of the front support member when the front support member is in the first position and the center of mass of the helmet shell is at a second distance from the base portion of the front support member when the front support member is in the second position, and wherein the first distance is greater than the second distance to accommodate a plurality of head sizes while retaining the center of mass of the helmet shell in close proximity to the head of the user when the front support member moves between the first position, the second position, and the intermediate positions.

20. The surgical helmet assembly of claim 19, wherein the helmet shell comprises a tension element guide disposed between the first and second ends of the helmet shell, at least a portion of the tension element being received by the tension element guide of the helmet shell.

* * * * *